US009523948B2

(12) United States Patent
Takane

(10) Patent No.: US 9,523,948 B2
(45) Date of Patent: Dec. 20, 2016

(54) IMAGE FORMING APPARATUS, IMAGE FORMATION CONTROL METHOD, AND COMPUTER PROGRAM PRODUCT

(71) Applicant: Toshiaki Takane, Osaka (JP)

(72) Inventor: Toshiaki Takane, Osaka (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/632,855

(22) Filed: Feb. 26, 2015

(65) Prior Publication Data

US 2015/0253703 A1 Sep. 10, 2015

(30) Foreign Application Priority Data

Mar. 4, 2014 (JP) ..... 2014-041838
May 22, 2014 (JP) ..... 2014-105771

(51) Int. Cl.
*G03G 15/20* (2006.01)

(52) U.S. Cl.
CPC ..... *G03G 15/2039* (2013.01)

(58) Field of Classification Search
CPC ..... G03G 15/205; G03G 15/2078
See application file for complete search history.

(56) References Cited

U.S. PATENT DOCUMENTS 8,502,994 B2 * 8/2013 Lee ..... G03G 15/5025 358/1.13
2004/0234286 A1 * 11/2004 Takahashi ..... G03G 15/205 399/53
2009/0060553 A1 * 3/2009 Okabayashi ..... G03G 15/2039 399/70
2012/0229819 A1 * 9/2012 Koyatsu ..... G03G 15/0126 358/1.1
2012/0237227 A1 9/2012 Takane et al.
2013/0322907 A1 * 12/2013 Namiki ..... G03G 13/20 399/69

FOREIGN PATENT DOCUMENTS

JP 2008040267 A 2/2008
JP 2008311240 A 12/2008
JP 2010211071 A 9/2010

* cited by examiner

*Primary Examiner* — W B Perkey
*Assistant Examiner* — Noam Reisner
(74) *Attorney, Agent, or Firm* — Harness, Dickey & Pierce, P.L.C.

(57) ABSTRACT

An image forming apparatus includes: a fixing unit configured to heat a recording medium on which a recording agent image is formed by an image forming unit, to fix the recording agent image; and a control unit configured to determine, as an image formation start temperature, a temperature of the fixing unit for making the image forming unit start image formation such that a timing at which the recording medium reaches the fixing unit is matched with a timing at which a temperature of the fixing unit is raised to fixing temperature allowing fixing as a result of starting feeding power from an external power supply to a heating unit configured to heat the fixing unit on the basis of a voltage value of the power, and make the image forming unit start image formation when a temperature of the fixing unit reaches the image formation start temperature.

15 Claims, 14 Drawing Sheets

FIG.3

TEMPERATURE REDUCTION TABLE Tb

| MAIN POWER [V] | REDUCTION AMOUNT FROM SET FIXING TEMPERATURE AT START OF IMAGE FORMATION |
|---|---|
| 90 TO 91 | 0.0 |
| 91 TO 92 | -0.5 |
| 92 TO 93 | -1.0 |
| 93 TO 94 | -1.5 |
| 94 TO 95 | -2.0 |
| 95 TO 96 | -2.5 |
| 96 TO 97 | -3.0 |
| 97 TO 98 | -3.5 |
| 98 TO 99 | -4.0 |
| 99 TO 100 | -4.5 |
| 100 TO 101 | -5.0 |
| 101 TO 102 | -5.5 |
| 102 TO 103 | -6.0 |
| 103 TO 104 | -6.5 |
| 104 TO 105 | -7.0 |
| 105 TO 106 | -7.5 |
| 106 TO 107 | -8.0 |
| 107 TO 108 | -8.5 |
| 108 TO 109 | -9.0 |
| 109 TO 110 | -9.5 |

IMAGE FORMING APPARATUS, IMAGE FORMATION CONTROL METHOD, AND COMPUTER PROGRAM PRODUCT

CROSS-REFERENCE TO RELATED APPLICATIONS

The present application claims priority to and incorporates by reference the entire contents of Japanese Patent Application No. 2014-041838 filed in Japan on Mar. 4, 2014 and Japanese Patent Application No. 2014-105771 filed in Japan on May 22, 2014.

BACKGROUND OF THE INVENTION

1. Field of the Invention

The present invention relates to an image forming apparatus, an image formation control method, and a computer program product.

2. Description of the Related Art

With an electrophotographic image forming apparatus, an electrostatic latent image is formed on a photoconductor on the basis of image data, and the electrostatic latent image is developed with a recording agent such as toner so that a recording agent image (hereinafter referred to as a toner image where appropriate) such as a toner image is formed. The image forming apparatus transfers the toner image on the photoconductor onto a recording medium (hereinafter simply referred to as a "sheet") such as a sheet or a film conveyed between the photoconductor and a transfer roller, and conveys the sheet on which the toner image is transferred to a fixing unit.

The fixing unit typically includes a fixing roller having a fixing heater therein and being configured to be heated to a fixing temperature by the fixing heater and driven to rotate, and a pressure roller that is pressed by the fixing roller and rotates therewith. When a sheet on which a toner image is transferred is conveyed to the fixing unit, the fixing unit heats the sheet while holding and conveying the sheet between the fixing roller and the pressure roller to fix the toner image on the sheet to the sheet.

The image forming apparatus of the related art then starts feeding power to the fixing heater of the fixing unit to raise temperature at the same time as starting a process of forming an electrostatic latent image on the photoconductor, that is, starting image forming operation, and heats the fixing roller to a fixing temperature suitable for fixing a toner image onto a sheet before the sheet is conveyed to between the fixing roller and the pressure roller.

In the meantime, while there also have recently been demands for reducing power consumption of image forming apparatuses, power consumption of the fixing unit, that is, consumption of fixing power is large in an electrophotographic image forming apparatus. There are thus demands for saving fixing power in image forming apparatuses.

Note that, in an image forming apparatus, the temperature of the fixing roller needs to be raised to such a temperature that does not cause fixing failure even when the voltage of an external commercial power supply to the image forming apparatus is a lower voltage limit according to a standard. Thus, in an image forming apparatus of the related art, feeding of the power to a fixing heater is started at a timing at which a fixing roller can be heated to a fixing temperature before a sheet reaches the fixing roller even when the voltage of an external commercial power supply is a lower voltage limit. When the external commercial power supply has a normal power supply voltage higher than the lower voltage limit, power feeding control to maintain the fixing roller at the fixing temperature therefore needs to be performed on the fixing heater from when the fixing roller is heated to the fixing temperature before the sheet comes into contact with the fixing roller until when the sheet then comes into contact with the fixing roller. As a result, power is wasted after the fixing temperature is reached until the fixing operation is actually carried out.

In the related art, there is proposed an image forming apparatus including a main power supply, an auxiliary power supply including a chargeable and dischargeable power storage device, and a fixing device including a heating element that produces heat when power is supplied from at least one of the main power supply and the auxiliary power supply, wherein when a voltage value input from a commercial power supply to the main power supply, environmental temperature, or the voltage value of the auxiliary power supply is not larger than a predetermined value, power stored in the auxiliary power supply is not supplied to the fixing device at start-up (refer to Japanese Laid-open Patent Publication No. 2008-311240).

Thus, in this related art, power consumption of the auxiliary power supply is suppressed by suppressing power supply from the auxiliary power supply.

In the related art taught by the aforementioned publication, however, since only supply of auxiliary power is suppressed, power consumption from when the fixing temperature is reached until when actual fixing operation is carried out cannot be reduced, and improvement is required for reducing power consumption for fixing.

In view of the above, there is a need to reduce power used for fixing.

SUMMARY OF THE INVENTION

It is an object of the present invention to at least partially solve the problems in the conventional technology.

An image forming apparatus includes: an image forming unit configured to form a recording agent image on a recording medium; a fixing unit configured to heat the recording medium on which the recording agent image is formed by the image forming unit and which is conveyed to the fixing unit, to fix the recording agent image onto the recording medium; a heating unit configured to heat the fixing unit depending on an amount of fed power; a temperature detection unit configured to detect the temperature of the fixing unit; a power supply generation unit configured to generate power for heating to be supplied to the heating unit from power from an external power supply; a voltage detection unit configured to detect a voltage value of the power from the external power supply; and a control unit configured to determine, as an image formation start temperature, a temperature of the fixing unit for making the image forming unit start image formation such that a timing at which the recording medium on which the recording agent image is formed reaches the fixing unit is matched with a timing at which a temperature of the fixing unit is raised to fixing temperature allowing fixing by the fixing unit as a result of starting feeding the power for heating to the heating unit on the basis of the voltage value of the power from the external power supply, and make the image forming unit start image formation when a temperature of the fixing unit reaches the image formation start temperature.

An image formation control method includes: forming a recording agent image on a recording medium; heating, by a fixing unit, the recording medium on which the recording agent image is formed at the forming and which is conveyed, to fix the recording agent image onto the recording medium; heating, by a heating unit, the fixing unit depending on an amount of fed power; detecting a temperature of the fixing unit; generating power for heating to be supplied to the heating unit from power from an external power supply; detecting a voltage value of the power from the external power supply; and determining, as an image formation start temperature, a temperature of the fixing unit for causing image formation at the forming to be started such that a timing at which the recording medium on which the recording agent image is formed reaches the fixing unit is matched with a timing at which a temperature of the fixing unit is raised to fixing temperature allowing fixing by the fixing unit as a result of starting feeding the power for heating to the heating unit on the basis of the voltage value of the power from the external power supply, and causing image formation at the forming to be started when a temperature of the fixing unit reaches the image formation start temperature A computer program product includes a non-transitory computer-readable medium containing an information processing program. The program causes a control processor to execute: forming a recording agent image on a recording medium; heating, by a fixing unit, the recording medium on which the recording agent image is formed at the forming and which is conveyed, to fix the recording agent image onto the recording medium; heating, by a heating unit, the fixing unit depending on an amount of fed power; detecting a temperature of the fixing unit; generating power for heating to be supplied to the heating unit from power from an external power supply; detecting a voltage value of the power from the external power supply; and determining, as an image formation start temperature, a temperature of the fixing unit for causing image formation at the forming to be started such that a timing at which the recording medium on which the recording agent image is formed reaches the fixing unit is matched with a timing at which a temperature of the fixing unit is raised to fixing temperature allowing fixing by the fixing unit as a result of starting feeding the power for heating to the heating unit on the basis of the voltage value of the power from the external power supply, and causing image formation at the forming to be started when a temperature of the fixing unit reaches the image formation start temperature.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a table illustrating an example of a temperature reduction table;

DETAILED DESCRIPTION OF THE PREFERRED EMBODIMENTS

A preferred embodiment of the present invention will be described in detail below with reference to the accompanying drawings. Note that the embodiment described below is a preferred embodiment of the present invention and thus various technically preferable limitations are added thereto, but the scope of the present invention is not to be wrongfully limited by the description below and not all the components described in the embodiment are essential to the present invention.

First Embodiment

Figure 1:
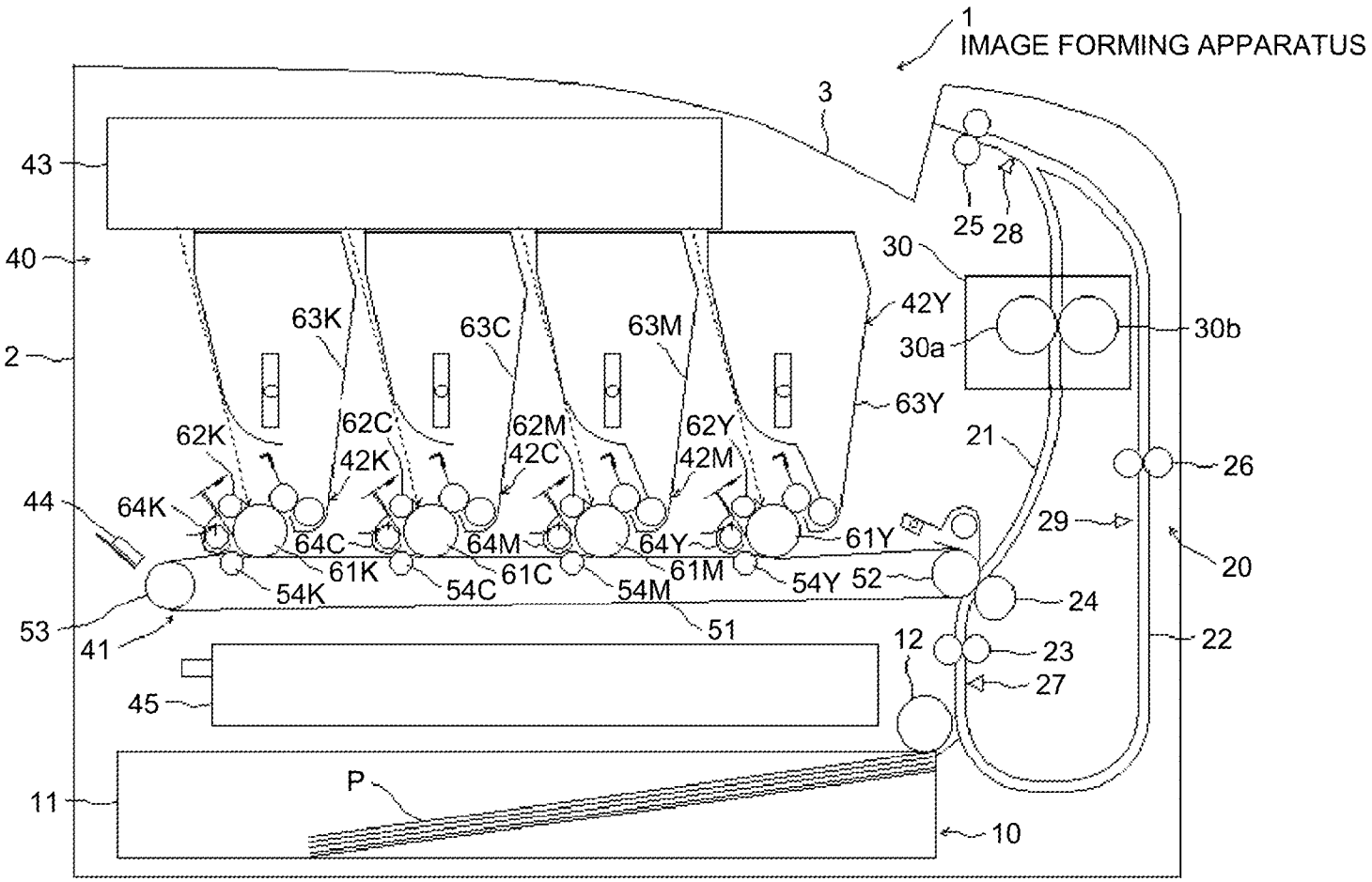
FIG. 1 is a schematic configuration diagram of an image forming apparatus to which an embodiment of the present invention is applied.

FIGS. 1 to 13 are diagrams illustrating an embodiment of an image forming apparatus, an image formation control method, and a computer program product according to the present invention, in which FIG. 1 is a schematic configuration diagram of an image forming apparatus 1 to which the embodiment of the image forming apparatus, the image formation control method, and the computer program product according to the present invention is applied.

In FIG. 1, the image forming apparatus 1 includes a sheet feeding unit 10, a conveyance unit 20, and a printing unit 40 in a body housing 2, and is provided with a sheet ejection tray 3 on the body housing 2. The image forming apparatus 1 includes an operation display unit, which is not illustrated, including various operation keys and a display.

The sheet feeding unit 10 includes a sheet feeding tray 11, a sheet feeding roller 12, and a separating pad, which is not illustrated, and a plurality of sheets (recoding media) P is accommodated in the sheet feeding tray 11. The sheet feeding unit 10 separates one sheet from the sheets P in the sheet feeding tray 11 at a time with the sheet feeding roller 12 and the separating pad, and feeds the sheet to the conveyance unit 20.

The conveyance unit 20 includes a forward conveyance path 21, a duplex conveyance path 22, registration rollers 23, a secondary transfer roller 24, sheet ejection rollers 25, duplex rollers 26, a registration sensor 27, a sheet ejection sensor 28, a duplex sensor 29, a fixing unit 30, and multiple conveyance rollers, which are not illustrated. The conveyance unit 20 conveys a sheet P fed from the sheet feeding unit 10 along the forward conveyance path 21 to the registration rollers 23, and the sheet P conveyed to the registration rollers 23 is detected by the registration sensor 27. The image forming apparatus 1 temporarily stops conveyance of the sheet P at the registration rollers 23, then controls driving of the registration rollers 23 on the basis of the result of detection of the sheet P by the registration sensor 27 and the status of toner image formation at the printing unit 40, adjusts the timing of the sheet P with respect to a toner image formed by the printing unit 40, and conveys the sheet P to the secondary transfer roller 24. The conveyance unit 20 conveys the sheet P to the fixing unit 30 while causing a color toner image formed by the printing unit 40 to be transferred onto the sheet P conveyed from the registration rollers 23 by the secondary transfer roller 24 as will be described later.

The fixing unit 30 includes a fixing roller (fixing unit) 30*a* and a pressure roller 30*b*, and is configured to hold the sheet P between the fixing roller 30*a* and the pressure roller 30*b*, and heat and apply pressure to the sheet P while conveying the sheet P to fix the toner image on the sheet P to the sheet P. The fixing unit 30 conveys the sheet P on which fixing is completed to the sheet ejection rollers 25.

When the sheet P conveyed to the sheet ejection rollers 25 is detected by the sheet ejection sensor 28 and when duplex image formation is to be carried out on the sheet P but image formation on one side of the sheet P is completed, the conveyance unit 20 reverses the sheet ejection rollers 25 at an appropriate timing to feed the sheet P to the duplex conveyance path 22. After feeding the sheet P to the duplex conveyance path 22, the conveyance unit 20 conveys the sheet P by the duplex rollers 26, and the sheet P conveyed along the duplex conveyance path 22 is detected by the duplex sensor 29. The conveyance unit 20 conveys the sheet fed to the duplex conveyance path 22 again to the registration rollers 23 from the duplex conveyance path 22 to form an image on the rear side of the sheet P and fix the image at the fixing unit 30 similarly to the above, and ejects the sheet P onto the sheet ejection tray 3 by the sheet ejection rollers 25.

The printing unit (image forming unit) 40 includes an intermediate transfer unit 41, process cartridges 42C, 42M, 42Y, and 42K of C (cyan), M (magenta), Y (yellow), and K (black), respectively, an exposure unit 43, a calibration sensor 44, and a waste toner box 45. The intermediate transfer unit 41 includes an intermediate transfer belt 51, a secondary transfer drive roller 52, and a tension roller 53, transfer rollers 54Y, 54M, 54C, and 54K for the respective colors CMYK. In the intermediate transfer unit 41, the intermediate transfer belt 51 formed in an endless ring shape is looped around the secondary transfer drive roller 52 and the tension roller 53 substantially horizontally. The secondary transfer drive roller 52 is arranged in a state in which the secondary transfer drive roller 52 is in contact with the secondary transfer roller 24 with the intermediate transfer belt 51 therebetween.

In the printing unit 40, the process cartridges 42Y, 42M, 42C, and 42K of CMYK are arranged along the intermediate transfer belt 51. The process cartridges 42Y, 42M, 42C, and 42K are accommodated in cartridge cases, which are not illustrated, in a state in which charging rollers 62Y, 62M, 62C, and 62K, developing/toner accommodating units 63Y, 63M, 63C, and 63K, cleaning units 64Y, 64M, 64C, and 64K, and the like are arranged around photoconductors 61Y, 61M, 61C, and 61K that are driven to rotate in the clockwise direction in FIG. 1. The process cartridges 42Y, 42M, 42C, and 42K are accommodated in the body housing 2 and mounted in a state in which the photoconductors 61Y, 61M, 61C, and 61K thereof are opposed to and in contact with the transfer rollers 54Y, 54M, 54C, and 54K of the respective colors with the intermediate transfer belt 51 therebetween. In the printing unit 40, the intermediate transfer belt 51 is conveyed between the photoconductors 61Y, 61M, 61C, and 61K of the process cartridges 42Y, 42M, 42C, and 42K and the transfer rollers 54Y, 54M, 54C, and 54K, respectively.

The exposure unit 43 includes a polygon motor, a polygon mirror, an Fe lens, laser diodes, and a mirror, which are not illustrated. The exposure unit 43 emits writing light rays for the process cartridges 42Y, 42M, 42C, and 42K of the respective colors modulated on the basis of image data of the respective colors from the laser diodes to the polygon mirror driven to rotate by the polygon motor. The exposure unit 43 deflects the writing light rays into the main-scanning direction by the polygon mirror, and irradiates the photoconductors 61Y, 61C, 61M, and 61K uniformly charged by the charging rollers 62Y, 62M, 62C, and 62K of the process cartridges 42Y, 42M, 42C, and 42K with the writing light rays via the fθ lens, the mirror, and the like as indicated by broken arrows in FIG. 1 to form electrostatic latent images on the photoconductors 61Y, 61C, 61M, and 61K of the respective colors.

The printing unit 40 supplies toner (recording agents) of the respective colors onto the photoconductors 61Y, 61C, 61M, and 61K on which the electrostatic latent images are formed by the developing/toner accommodating units 63Y, 63M, 63C, and 63K while rotating the photoconductors 61Y, 61C, 61M, and 61K in the clockwise direction to develop the electrostatic latent images. The printing unit 40 sequentially transfers the toner images (recording agent images) of the respective colors formed on the photoconductors 61Y, 61C, 61M, and 61K over one another onto the intermediate transfer belt 51 by the transfer rollers 54Y, 54M, 54C, and 54K, respectively, to form a color toner image. The printing unit 40 further rotates the photoconductors 61Y, 61C, 61M, and 61K from which transfer of toner images is completed, to remove remaining toner by the cleaning units 64Y, 64M, 64C, and 64K and then recharge the photoconductors 61Y, 61C, 61M, and 61K by the charging rollers 62Y, 62M, 62C, 62K for image formation.

The intermediate transfer belt 51 is driven to rotate in the counterclockwise direction by the secondary transfer drive roller 52 to transfer the toner image onto the sheet P conveyed from the registration rollers 23 to between the secondary transfer roller 24 and the intermediate transfer belt 51 at the secondary transfer drive roller 52.

Note that, in printing only in black, the printing unit 40 carries out image formation while retracting the transfer rollers 54Y, 54M, and 54C other than the transfer roller 54K for black away from the photoconductors 61Y, 61M, and 61C, respectively.

The printing unit 40 also forms a pattern image on the intermediate transfer belt 51 to carry out a predetermined calibration process such as a color shift correction process and a density adjustment process, and detects the pattern image by the calibration sensor 44. The calibration sensor 44 is a reflective optical sensor, for example, and is configured to detect the positions and the densities of pattern images formed on the intermediate transfer belt 51 by the process cartridges 42Y, 42M, 42C, and 42K.

Figure 2:
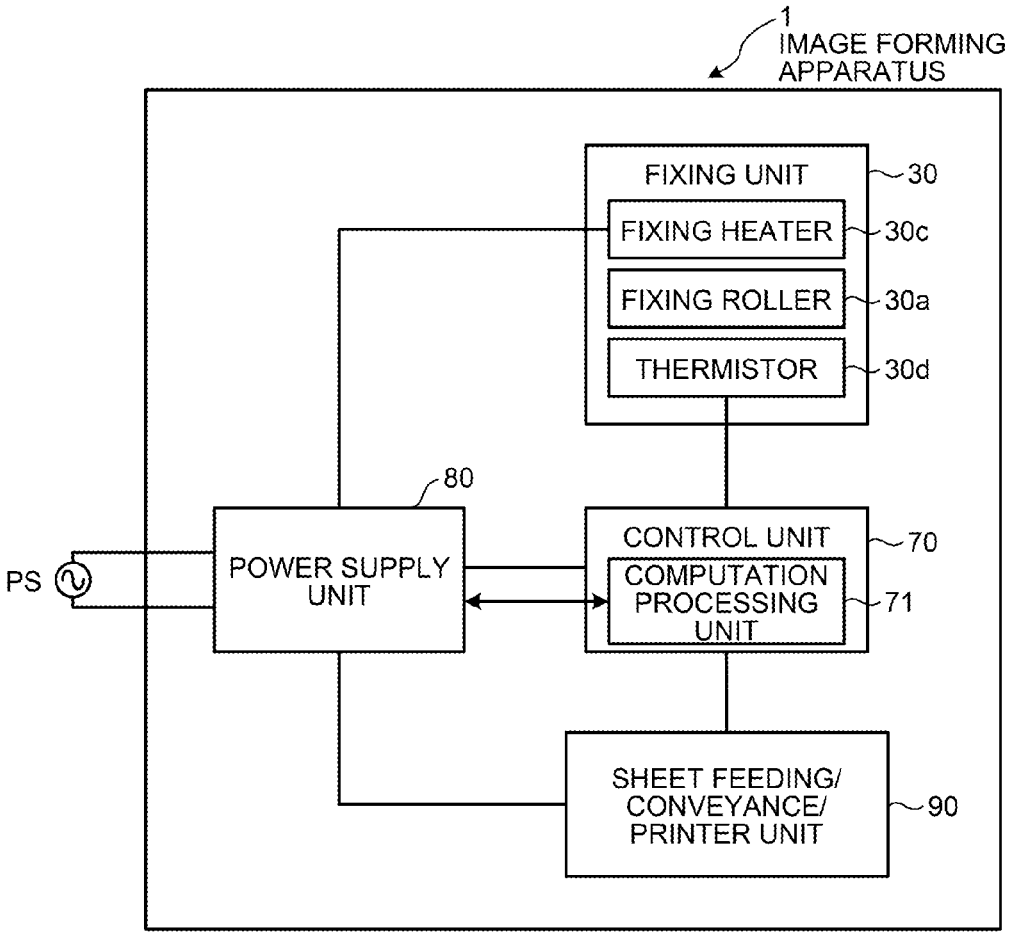
FIG. 2 is a configuration diagram of main blocks of the image forming apparatus.

A main part of a power supply system of the image forming apparatus 1 has a block configuration as illustrated in FIG. 2. Specifically, the image forming apparatus 1 includes a control unit 70, a power supply unit 80, a sheet feeding/conveyance/printer unit 90, and the fixing unit 30.

The fixing unit 30 includes the fixing roller (fixing unit) 30*a*, and the pressure roller 30*b* that are arranged in a rotatable manner as described above, and the fixing roller 30*a* is controlled to be heated to predetermined standby temperature and fixing temperature by a fixing heater 30*c* provided therein.

The fixing heater (heating unit) 30*c* is a halogen heater, for example, and is configured to produce heat depending on the amount of fed power to heat the fixing roller 30*a*.

The fixing unit 30 is provided with a thermistor 30*d* at a position near the surface of the fixing roller 30*a*, and the thermistor (temperature detecting unit) 30*d* detects the surface temperature of the fixing roller 30*a* and outputs the detected temperature to the control unit 70. Note that the thermistor 30*d* may be of a contact type that comes in contact with the surface of the fixing roller 30*a* to detect the temperature or of a non-contact type.

Power PS from an external commercial power supply is supplied to the power supply unit (power supply generation unit) 80 via a power switch (not illustrated) of the image forming apparatus 1, and the power supply unit 80 carries out processing such as AC/DC (alternating current to direct current) conversion, voltage conversion, and rectification on the power PS from the external power supply and supplies power to the respective components of the image forming apparatus 1. In particular, the power supply unit 80 uses the power PS supplied from the external power supply under the control of the control unit 70 to control supply of power (fixing power) for heating to the fixing heater 30*c*.

The sheet feeding/conveyance/printer unit 90 is a general term of the sheet feeding unit 10, the conveyance unit 20, and the printing unit 40, and driving power from the power supply unit 80 is supplied thereto.

The control unit 70 includes a computation processing unit 71, and a read only memory (ROM), a random access memory (RAM), and a nonvolatile memory, which are not illustrated. The ROM stores basic programs of the image forming apparatus 1, programs such as the image formation control program according to the present invention, system data, and the like, and the RAM is used as a working memory for the computation processing unit 71.

The nonvolatile memory (storage unit) is a nonvolatile RAM (NVRAM), for example, and stores data that need to be stored even while the image forming apparatus 1 is power-off. In particular, the nonvolatile memory stores various data used in image formation control processes according to the present invention such as a lower voltage limit, a threshold voltage, a temperature reduction table (image formation start temperature table), a color/monochrome associated temperature reduction table, an image size associated temperature reduction table, a printing rate associated temperature reduction table, and an external environmental temperature associated temperature reduction table.

Note that the lower voltage limit refers to a voltage value representing a threshold for determining whether or not to change the temperature (hereinafter referred to as image formation start temperature where appropriate) of the fixing roller 30*a* at starting of image formation from a preset image formation start temperature to a reduced image formation start temperature so as to reduce fixing power. The threshold voltage is a voltage such as product specification voltage or nominal voltage representing a threshold for determining whether or not the image forming apparatus 1 can be safely operated. The temperature reduction table Tb is a table indicating temperature reduction from a preset image formation start temperature of the fixing roller temperature at starting of image formation in association with the voltage value of the power PS from the external power supply as illustrated in FIG. 3. The color/monochrome associated temperature reduction table is a table indicating temperature reduction from a preset image formation start temperature depending on whether image formation based on image data is in color or in monochrome in association with the voltage value of the power PS from the external power supply. The image size associated temperature reduction table is a table indicating temperature reduction from a preset image formation start temperature depending on the size of an image formed on the basis of image data in association with the voltage value of the power PS from the external power supply. The printing rate associated temperature reduction table is a table indicating temperature reduction from a preset image formation start temperature depending on the printing rate of an image formed on the basis of image data in association with the voltage value of the power PS from the external power supply. The external environmental temperature associated temperature reduction table is a table indicating temperature reduction from a preset image formation start temperature depending on the external environmental temperature of the image forming apparatus 1 in association with the voltage value of the power PS from the external power supply. When the external environmental temperature associated temperature reduction table is used to control the image formation start temperature, the image forming apparatus 1 thus includes a temperature sensor, which is not illustrated, to detect the external environmental temperature, and the temperature sensor outputs the detected external environmental temperature to the control unit 70.

The computation processing unit (control unit, recording agent image type acquisition unit, image ratio acquisition unit, image size acquisition unit) 71 is implemented by a central processing unit (CPU) or the like. The computation processing unit 71 controls the respective units of the image forming apparatus 1 by using the RAM as a working memory on the basis of the programs in the ROM to perform basic processes of the image forming apparatus 1 and perform image formation control processes according to the present invention. In particular, the computation processing unit 71 controls start of image formation operation at the printing unit 40 in carrying out an image formation control method.

The computation processing unit 71 also functions as a recording agent image type acquisition unit that carries out a recording agent image type acquisition process of analyzing a print job to acquire whether the type of a toner image (recording agent image) to be formed on a sheet P through image formation is in monochrome or in color.

The computation processing unit 71 further functions as an image ratio acquisition unit that carries out an image ratio acquisition process of analyzing a print job to acquire a printing rate that is a ratio of a toner image (recording agent image) to be formed on a sheet P through image formation to the sheet P.

The computation processing unit 71 also functions as an image size acquisition unit that carries out an image size acquisition process of analyzing a print job to acquire an image size of a toner image (recording agent image).

Specifically, the image forming apparatus 1 is built as an image forming apparatus 1 that carries out an image formation control method to reduce power used for fixing, which will be described later, by reading an image formation control program for performing the image formation control method according to the present invention recorded on a computer-readable recording medium such as a ROM, an electrically erasable and programmable read only memory (EEPROM), and EPROM, flash memory, a flexible disk, a compact disc read only memory (CD-ROM), a compact disc rewritable (CD-RW), a digital versatile disk (DVD), a secure digital (SD) card, or a magneto-optical (MO) disc and installing the program into the ROM or the like of the control unit 70. The image formation control program is a program written in a legacy programming language, an object-oriented programming language or the like such as the assembler, C, C++, C#, or Java (registered trademark) that can be executed by a computer, and can be stored in the recording medium and distributed.

Figure 4:
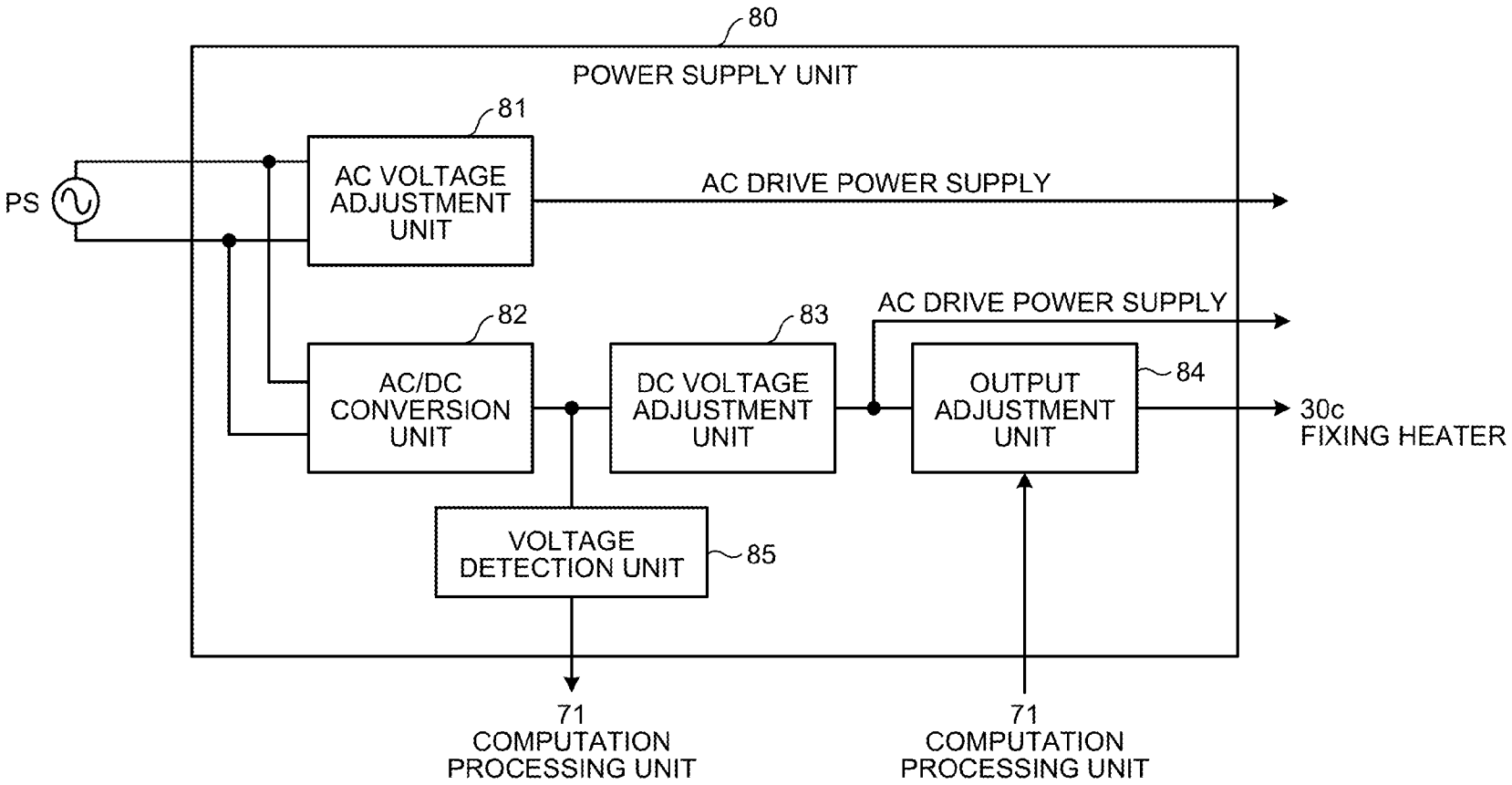
FIG. 4 is a configuration diagram of main blocks of a power supply unit.

The power supply unit 80 includes an alternating current (AC) voltage adjustment unit 81, an AC/DC (alternating current/direct current) conversion unit 82, a direct current (DC) voltage adjustment unit 83, an output adjustment unit 84, a voltage detection unit 85, and the like as illustrated in the configuration of main blocks in FIG. 4.

The power PS from the external power supply is supplied to the AC voltage adjustment unit 81 and the AC/DC conversion unit 82 via a power switch (not illustrated).

The AC voltage adjustment unit 81 is a switching circuit or the like, and is configured to adjust the voltage of the power PS from the external power supply to a voltage value suitable for use in the image forming apparatus 1 by AC switching, and supplies the adjusted power as AC drive power supply to an AC driving source of the image forming apparatus 1.

The AC/DC conversion unit 82 is a rectifier circuit including a diode bridge and a transformer, for example, and is configured to convert the power PS from the external power supply to DC power and output the DC power to the DC voltage adjustment unit 83 and the voltage detection unit 85.

The DC voltage adjustment unit 83 includes a DC-DC converter, for example. The DC voltage adjustment unit 83 converts the voltage of the DC power output from the AC/DC conversion unit 82 to a predetermined voltage value required in the image forming apparatus 1, supplies the DC power as DC drive power supply to the respective components of the image forming apparatus 1 and also outputs the DC power to the output adjustment unit 84.

The output adjustment unit 84 includes a photo-coupler and triac or a power transistor, for example, and receives an output adjustment signal from the computation processing unit 71. The output adjustment unit 84 supplies and interrupts supply of the DC drive power (power supply for heating) from the DC voltage adjustment unit 83 to the fixing heater 30*c* according to the output adjustment signal, and controls the amount of power supply for heating (the amount of fed power) to the fixing heater 30*c* by switching on/off through pulse width modulation (PWM) according to PWM of the output adjustment signal.

The voltage detection unit (voltage detection unit) 85 detects the voltage value of the DC power output from the AC/DC conversion unit 82 to detect the voltage value of the power PS from the external power supply, converts the detected voltage value into a digital value by an A/D converter, and outputs the digital value to the computation processing unit 71 of the control unit 70. Note that the voltage detection unit 85 is not limited to one that detects the voltage value of the DC power output from the AC/DC conversion unit 82 as described above. For example, the voltage detection unit 85 may be one that directly detects a voltage value of the AC power PS from the external power supply by using an A/D converter and outputs the detected voltage value to the computation processing unit 71 of the control unit 70. When an A/D converter is used in this manner, detection of the voltage value of the power PS from the external power supply can be with high accuracy with finer resolution of the A/D converter, and power consumption in fixing can be reduced with high accuracy.

Next, operation of the present embodiment will be described. The image forming apparatus 1 of the present embodiment reduces power used for fixing.

Specifically, the image forming apparatus 1 makes the sheet feeding unit 10, the conveyance unit 20, the printing unit 40 and the like operate under the control of the computation processing unit 71 of the control unit 70 to transfer a toner image based on image data onto a sheet P and convey the sheet P on which the toner image is transferred to the fixing unit 30.

The computation processing unit 71 controls feeding of the power to the fixing heater 30*c* to heat the fixing roller 30*a* to the fixing temperature and control the temperature. In a standby state in which fixing operation is not carried out, the computation processing unit 71 controls the fixing roller 30*a* at a predetermined standby temperature lower than the fixing temperature at which fixing can be carried out.

The image forming apparatus 1 also has a power saving mode in which power supply to the main components is stopped or reduced, and the computation processing unit 71 stops power supply to the fixing unit 30 in this power saving mode.

When the sheet P is conveyed to a pressure application point between the fixing roller 30*a* and the pressure roller 30*b* of the fixing unit 30, the computation processing unit 71 then heats and applies pressure to the sheet P by the fixing roller 30*a* heated to the fixing temperature and the pressure roller 30*b* while conveying the sheet P to fix the toner image on the sheet P to the sheet P.

Figure 5:
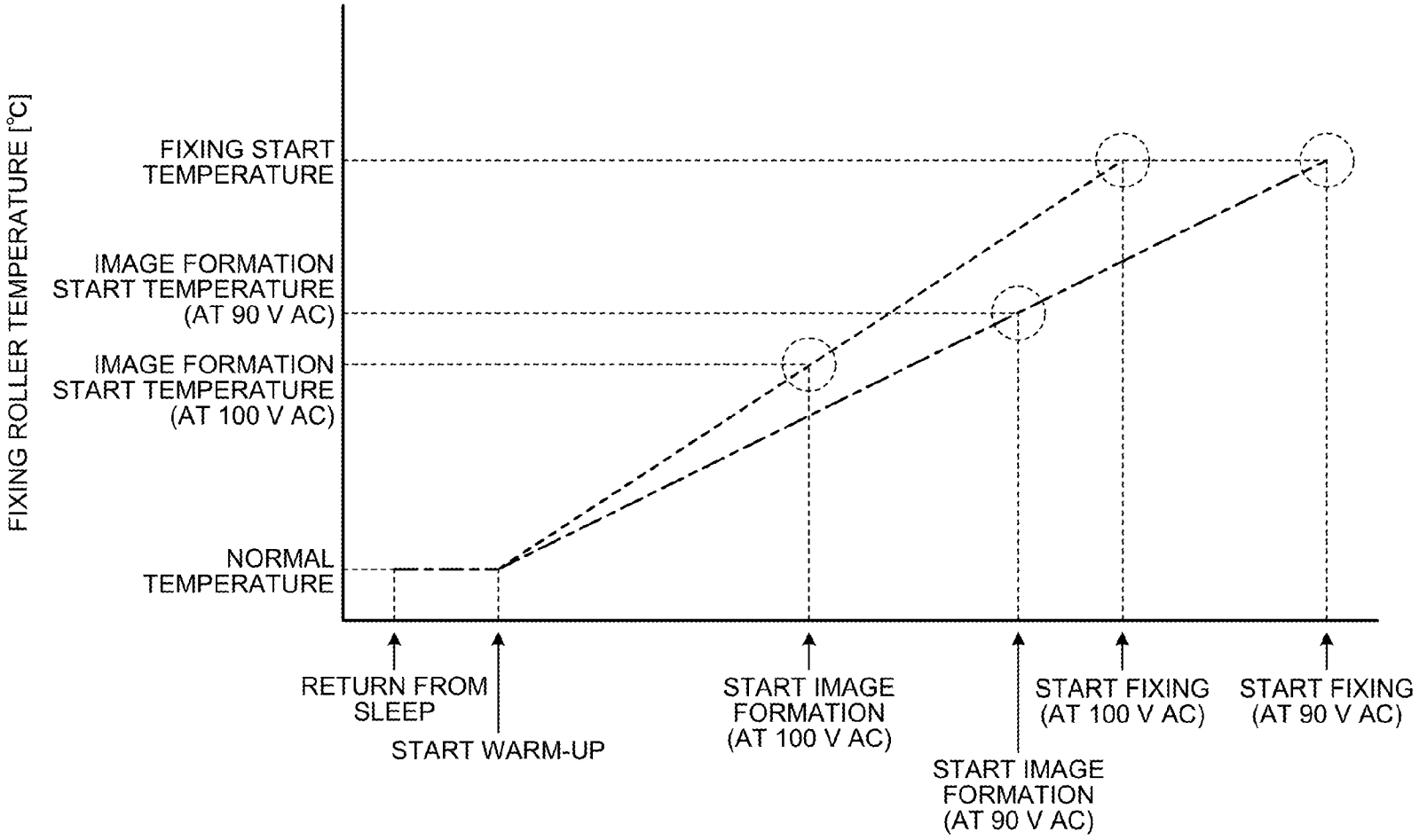
FIG. 5 is a graph illustrating the relation between variation in the temperature of a fixing roller and the voltage of external power supply from a power-off state until start of fixing.

For controlling the temperature of the fixing roller 30*a*, the computation processing unit 71 matches the timing at which the temperature of the fixing roller 30*a* rises to the fixing temperature (temperature at which fixing can be carried out) with the timing at which the sheet P on which the toner image is formed reaches the fixing unit 30 and determines the temperature of the fixing roller 30*a* for starting image formation by the printing unit 40 to be image formation start temperature as illustrated in FIG. 5. When the temperature of the fixing roller 30*a* reaches the image formation start temperature, the computation processing unit 71 starts image formation by the printing unit 40.

Specifically, in the power saving mode (sleep state) in which power supply to the main components is stopped or reduced, for example, the image forming apparatus 1 also stops feeding the power to the fixing heater 30*c*. In the power saving mode, the temperature of the fixing roller 30*a* is thus lowered to normal temperature or the like depending on the external temperature and the duration of the power saving mode. In the following description, the temperature of the fixing roller 30*a* at the time of returning from the power saving mode is referred to as "normal temperature" to make the description clear. When returning from sleep as a result of issuance of a print command in the power saving mode, for example, as illustrated in FIG. 5, the image forming apparatus 1 returns from sleep according to the print command, performs various settings and voltage detection and starts warm-up. After completing the warm-up, the image forming apparatus 1 uses the power PS from the external power supply to start feeding the power to the fixing heater 30*c*. The change in the temperature of the fixing roller 30*a*

(the change in the fixing roller temperature) heated by the fixing heater 30*c* varies depending on the voltage value of the power PS from the external power supply. In FIG. 5, for example, the time required for rising to the fixing start temperature (fixing temperature) from start of warm-up is shorter when the voltage value of the power PS from the external power supply (hereinafter referred to as external power supply voltage value where appropriate) is 100 V that is the rated voltage value (the rated voltage value in Japan, etc.) as shown by a broken line than when the voltage value is 90V as shown by a dashed-dotted line. The image forming apparatus 1 starts image formation by the printing unit 40 so that the sheet P on which the toner image is transferred is conveyed to the fixing unit 30 at the timing when the temperature of the fixing roller 30*a* reaches the fixing temperature from the start of the warm-up until the start of fixing. The time required for image formation from when the image formation is started until when the sheet P is conveyed to the fixing unit 30 is fixed for each image forming apparatus 1.

In the meantime, the image forming apparatus 1 needs to raise the temperature of the fixing roller 30*a* to the fixing temperature after the image formation is started and before start of fixing no matter what voltage value the power PS supplied from the external power supply has, as described above. Thus, in the image forming apparatus of the related art, the temperature of the fixing roller 30*a* at the start of image formation (hereinafter referred to as image formation start temperature where appropriate) is set at a high temperature in order to raise the temperature of the fixing roller 30*a* to the fixing temperature before the start of fixing even when the voltage value of the power PS supplied from the external power supply is lower than the rated voltage value. Specifically, the image formation start temperature is set so that the temperature of the fixing roller 30*a* is raised to the fixing temperature after the image formation is started and before the starting point of fixing even when the temperature rising rate of the fixing roller 30*a* is lower than the temperature rising rate at the rated voltage value.

Figure 6:
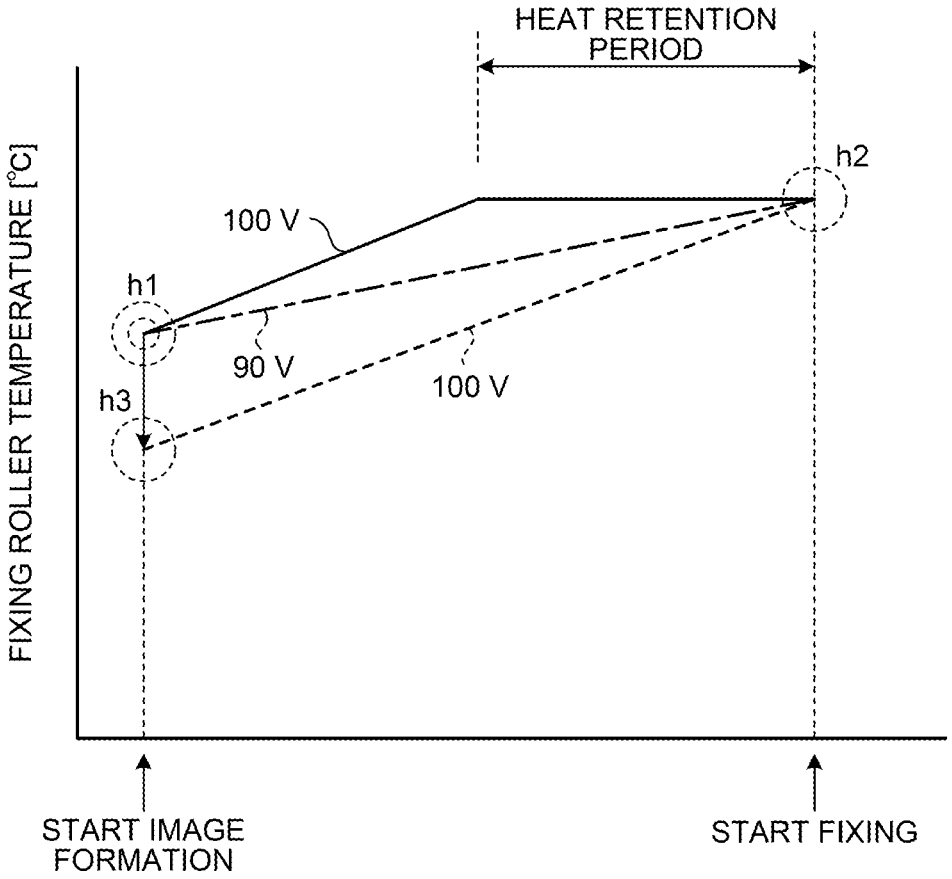
FIG. 6 is a graph illustrating the relation between variation in the temperature of the fixing roller and the voltage of the power from the external power supply based on a start point of image formation.

Thus, FIG. 5 can be redrawn on the basis of the starting point of image formation as illustrated in FIG. 6.

Specifically, although the power PS from the external power supply having the rated voltage value (100 V, for example) is normally input to the image forming apparatus 1, it is necessary in practice to assume a case where power having a voltage value lower than the rated voltage value of 100 V, such as a voltage value of 90V, is supplied to the image forming apparatus 1.

Furthermore, in the image forming apparatus of the related art, the image formation start temperature is set to a high temperature h1 so that the temperature of the fixing roller 30*a* reaches the fixing temperature h2 at the start of fixing even when the voltage value of the power PS from the external power supply is 90 V that is lower than the rated voltage value (100 V) as illustrated in FIG. 6.

When the voltage value (external power supply voltage value) of the power PS from the external power supply is the rated voltage value, however, as shown by a solid line in FIG. 6, the temperature of the fixing roller 30*a* rises to the fixing temperature h2 earlier than when the voltage value is 90V. As a result, the image forming apparatus 1 needs to feed the power to the fixing heater 30*c* to maintain the fixing roller 30*a* at the fixing temperature during the temperature retention period shown in FIG. 6. The power consumption during the temperature retention period is wasted power.

The image forming apparatus 1 according to the present invention therefore monitors the voltage value (external power supply voltage value) of the power PS from the external power supply. The image forming apparatus 1 does not change the image formation start temperature from the initially set temperature h1 that is sufficiently high when the external power supply voltage value is lower than the rated voltage value, and changes the image formation start temperature to a temperature h3 lower than the initially set temperature h1 when the external power supply voltage value is the rated voltage value. The image forming apparatus 1 then performs control to start image formation at the time point when the temperature of the fixing roller 30*a* reaches the low temperature h3 resulting from the change.

Such control allows image formation to be started at the time point when the temperature of the fixing roller 30*a* is the lower temperature h3 when the external power supply voltage value is the rated voltage value as can be seen in FIG. 6, which can reduce power consumption for heating the fixing roller 30*a*.

Specifically, the image forming apparatus 1 detects the voltage value of the power PS from the external power supply by the voltage detection unit 85, detects the temperature of the fixing roller 30 by the thermistor 30*d*, and controls the fixing roller temperature at the start of image formation (hereinafter referred to as image formation start temperature) depending on the external power supply voltage under the control of the computation processing unit 71. Furthermore, the image forming apparatus 1 can set the image formation start temperature to a lower temperature when the external power supply voltage value is 100 V than that when the voltage value is 90 V. Specifically, when the external power supply voltage value is 100 V, the temperature of the fixing roller 30*a* can be raised from the low fixing lower temperature (h3 in FIG. 6) to the fixing temperature h2 during the time required for image formation.

In the image forming apparatus 1, the temperature of the fixing roller 30*a* at the start of image formation is set in advance as preset image formation start temperature and stored in the nonvolatile memory of the control unit 70 so that image formation will be started at a timing at which the fixing roller temperature can be raised to the fixing temperature at the time of fixing even when the external power supply voltage value is about the lower voltage limit (90 V, for example).

In addition, since the temperature rising rate of the fixing roller 30*a* varies depending on the external power supply voltage value, the image forming apparatus 1 controls the image formation start temperature from the preset image formation start temperature so that the fixing roller temperature becomes the fixing temperature at the start of fixing on the basis of the external power supply voltage value to reduce power consumption.

Figure 7:
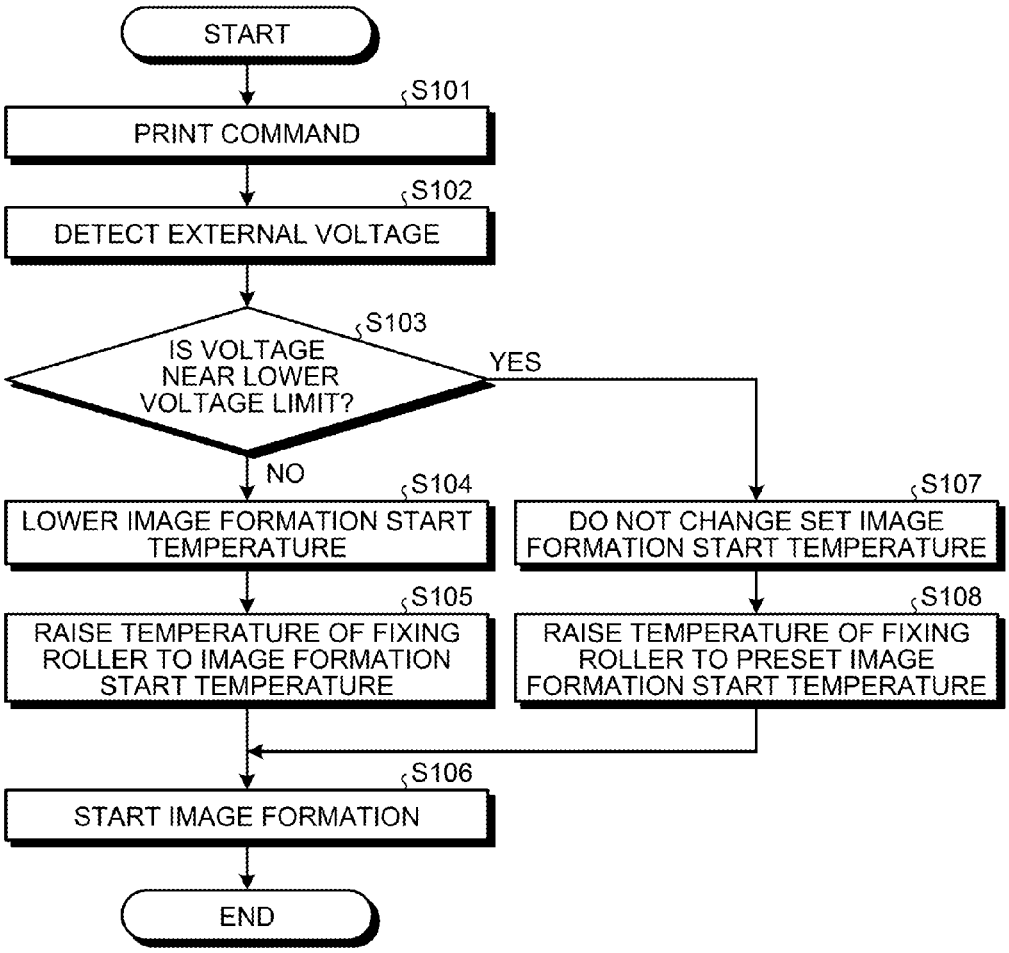
FIG. 7 is a flowchart illustrating a power saving control process in fixing.

The image forming apparatus 1 thus controls the temperature of the fixing roller 30*a* at the start of image formation detected by the thermistor 30*d* on the basis of the voltage value of the power PS from the external power supply detected by the voltage detection unit 85 taking the lower voltage limit into consideration as illustrated in FIG. 7.

Specifically, as illustrated in FIG. 7, when a print command is issued as a result of operation of the operation display unit, executing a print job received from a host device HS, which is not illustrated, or the like (step S101), the computation processing unit 71 acquires the voltage value (external power supply voltage value) of the power PS from the external power supply from the voltage detection unit 85 (step S102).

The computation processing unit 71 checks whether the acquired external power supply voltage value is near the lower voltage limit stored in the nonvolatile memory (step S103). As described above, the lower voltage limit is a voltage value of the power PS from the external power supply representing a threshold to determine whether or not the image formation start temperature is to be changed to a temperature reduced from the preset image formation start temperature by a temperature reduction amount in order to reduce fixing power, and stored in the nonvolatile memory of the control unit 70.

If the external power supply voltage value is not near the lower voltage limit in step S103 (YES in step S103), the computation processing unit 71 determines that the image formation start temperature can be changed (reduced), and refers to the temperature reduction table Tb on the basis of the external power supply voltage value detected by the voltage detection unit 85 to obtain the temperature reduction amount. After obtaining the temperature reduction amount, the computation processing unit 71 subtracts the temperature reduction amount from the preset image formation start temperature to set the image formation start temperature (step S104). After setting the image formation start temperature, the computation processing unit 71 outputs an output adjustment signal for starting supply of power for heating to the fixing heater 30*c* to the output adjustment unit 84 of the power supply unit 80, and starts feeding the power to the fixing heater 30*c* to raise the temperature of the fixing roller 30*a* to the image formation start temperature (step S105). When the temperature of the fixing roller 30 detected by the thermistor 30*d* is raised to the image formation start temperature, the computation processing unit 71 makes the printing unit 4 start an image formation process (step S106). After the image formation and a fixing process are completed, the computation processing unit 71 terminates the image formation process.

If the external power supply voltage value is near the lower voltage limit in step S103 (YES in step S103), the computation processing unit 71 determines not to change the set image formation start temperature (step S107). The computation processing unit 71 outputs an output adjustment signal for starting supply of power for heating to the fixing heater 30*c* to the output adjustment unit 84 of the power supply unit 80, and starts feeding the power to the fixing heater 30*c* to raise the temperature of the fixing roller 30*a* to the preset image formation start temperature (step S108).

When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

Figure 8:
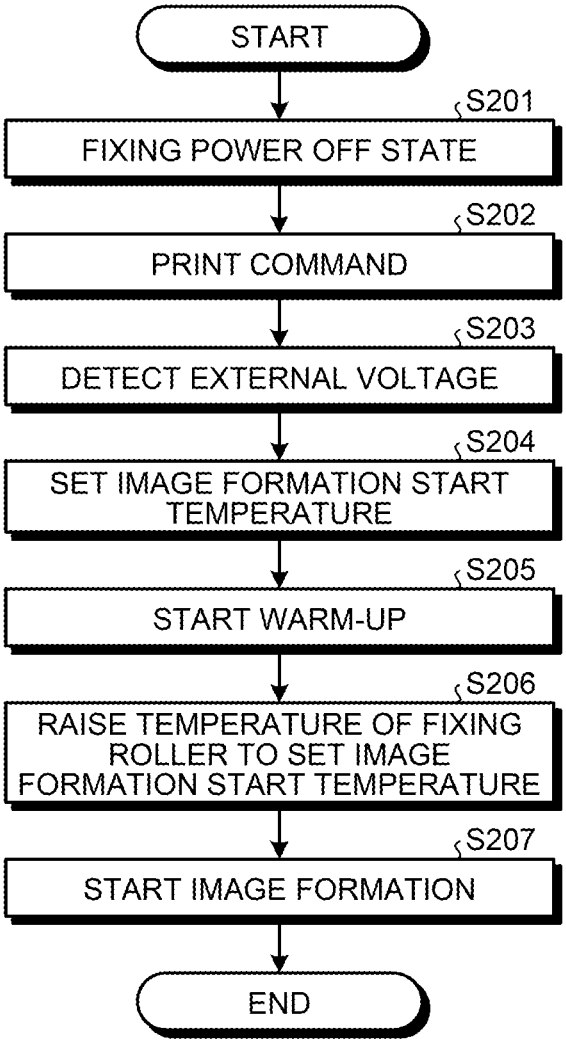
FIG. 8 is a flowchart illustrating a detailed power saving control process.

Further, the computation processing unit 71 performs a power saving process from the state in which the fixing unit 30 is power-off until the start of image formation as illustrated in FIG. 8 in detail. Specifically, when a print command is issued (step S202) in the power saving mode in which feeding of the power to the fixing unit 30 is off (step S201), the computation processing unit 71 returns from the power saving mode and acquires the voltage value (external power supply voltage value) of the power PS from the external power supply from the voltage detection unit 85 (step S203).

After acquiring the external power supply voltage value, the computation processing unit 71 sets the image formation start temperature on the basis of the external power supply voltage value (step S204). The computation processing unit 71 sets the image formation start temperature by referring to the temperature reduction table Tb (see FIG. 3) or the like on the basis of the lower limit temperature and the external power supply voltage detected by the voltage detection unit 85 as described above.

After setting the image formation start temperature, the computation processing unit 71 starts warm-up of the entire image forming apparatus 1 and the fixing unit 30 (step S205). After starting the warm-up, the computation processing unit 71 raises the temperature of the fixing roller 30*a* to the set image formation start temperature (step S206).

When the temperature of the fixing roller 30*a* detected by the thermistor 30*d* is raised to the image formation start temperature, the computation processing unit 71 makes the printing unit 4 start image formation, and terminates the power saving control process (step S207).

Specifically, if the external power supply voltage value is not near the lower voltage limit when the print command is issued, the computation processing unit 71 can set the image formation start temperature to an image formation start temperature lower than that when the voltage value is near the lower limit (90 V AC, for example) as the case of 100 V AC illustrated in FIG. 5. The time from the start of warm-up until the start of image formation can therefore be shortened and consumption of wasted power can be reduced. Furthermore, fixing can be started promptly after the fixing roller 30*a* is heated to the fixing temperature, and power for maintaining the fixing temperature until the start of fixing can be reduced so that power consumed at the fixing unit 30 can be reduced while the fixing performance is maintained.

To determine the image formation start temperature in step S104, the computation processing unit 71 calculates the temperature reduction amount by which the image formation start temperature is reduced from the preset image formation start temperature on the basis of an arithmetic expression represented by the following expression (1) stored in advance in the nonvolatile memory or the like on the basis of the external power supply voltage detected by the voltage detection unit 85 when the print command that is a printing start instruction is issued, for example:

$$\text{Temperature reduction amount}=(\text{external power supply voltage value}-\text{lower voltage limit})\times\text{coefficient} \quad (1).$$

In the expression, the coefficient is appropriately set depending on the type of the image forming apparatus 1, and the image size, the printing rate, the image type of color or monochrome, the external environmental temperature, and/or the like, which will be described later. The delay time is in units of a second.

The computation processing unit 71 subtracts the temperature reduction amount from the preset image formation start temperature as expressed by the following expression (2) to obtain the image formation start temperature:

$$\text{Image formation start temperature}=\text{preset image formation start temperature}-\text{temperature reduction amount} \quad (2).$$

The method for obtaining the temperature reduction amount is not limited to the obtaining method based on the arithmetic expression, but the temperature reduction amount may be obtained by reference to the temperature reduction table Tb illustrated in FIG. 3, for example.

Figure 9:
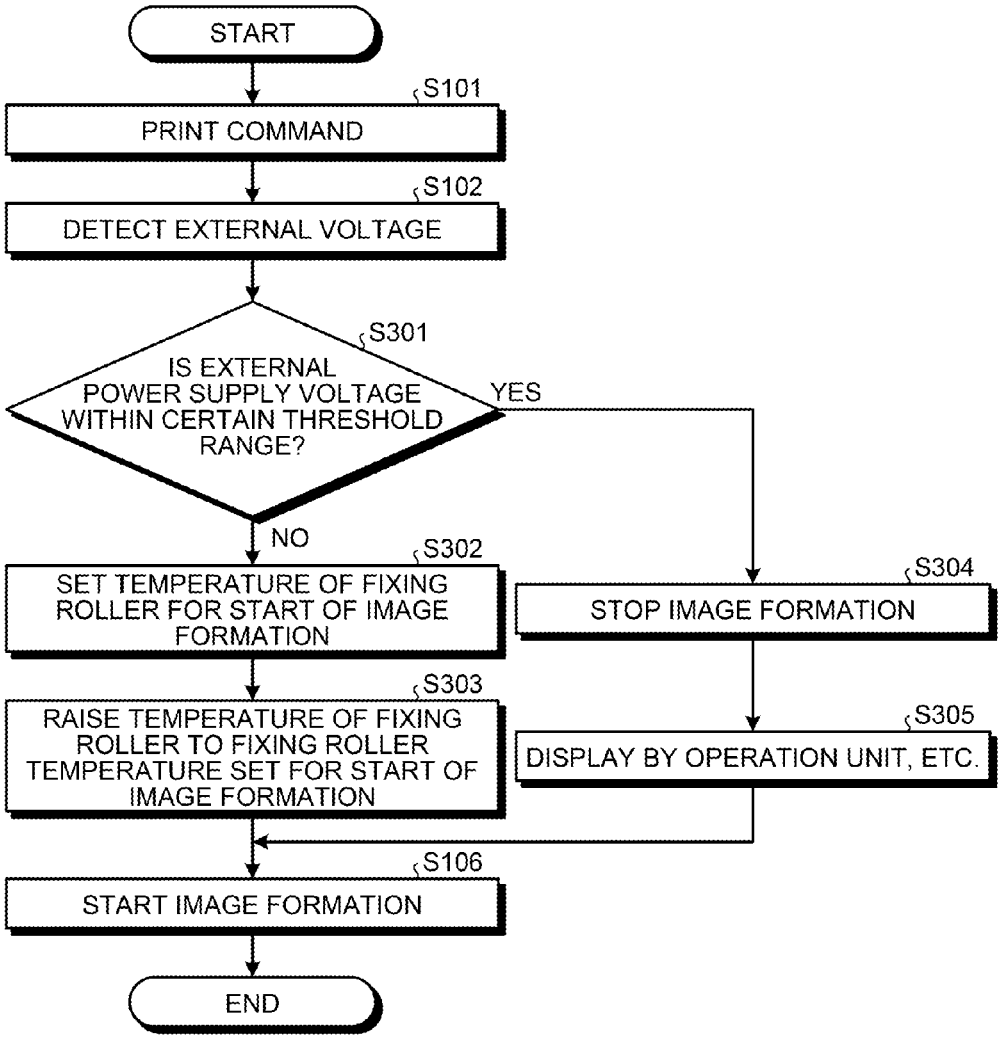
FIG. 9 is a flowchart illustrating a power saving control process in fixing based on a threshold voltage.

The computation processing unit 71 may carry out the power saving control process in fixing taking the threshold voltage into account as illustrated in FIG. 9. In FIG. 9, the processing steps that are the same as those in FIG. 7 are designated by the same step numbers and the description thereof will be simplified.

In this case, as illustrated in FIG. 9, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 checks whether the acquired external power supply voltage value is within a threshold voltage range stored in the nonvolatile memory (step S301). The threshold voltage is a voltage such as product specification voltage or nominal voltage representing a threshold for determining whether or not the image forming apparatus 1 can be safely operated as described above, and stored in the nonvolatile memory of the control unit 70.

If the external power supply voltage value is within the threshold voltage range in step S301 (YES in step S301), the computation processing unit 71 obtains and sets the image formation start temperature including the case in which no change is performed as described above (step S302). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S303). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

If the external power supply voltage value is not within the threshold voltage range in step S301 (NO in step S301), the computation processing unit 71 determines that the image formation process cannot be properly performed and stops the image formation process (step S304). After stopping the image formation process, the computation processing unit 71 displays that the image formation process is stopped, on the display of the operation display unit to inform the user of the same, and terminates the power saving control process (step S305).

In this manner, heating of the fixing roller 30*a* with reduced power consumption can be performed only within the range of the external power supply voltage value with which the image forming apparatus 1 operates normally, and power consumption in fixing can be reduced while ensuring the safety and the properness in image formation and fixing.

Figure 10:
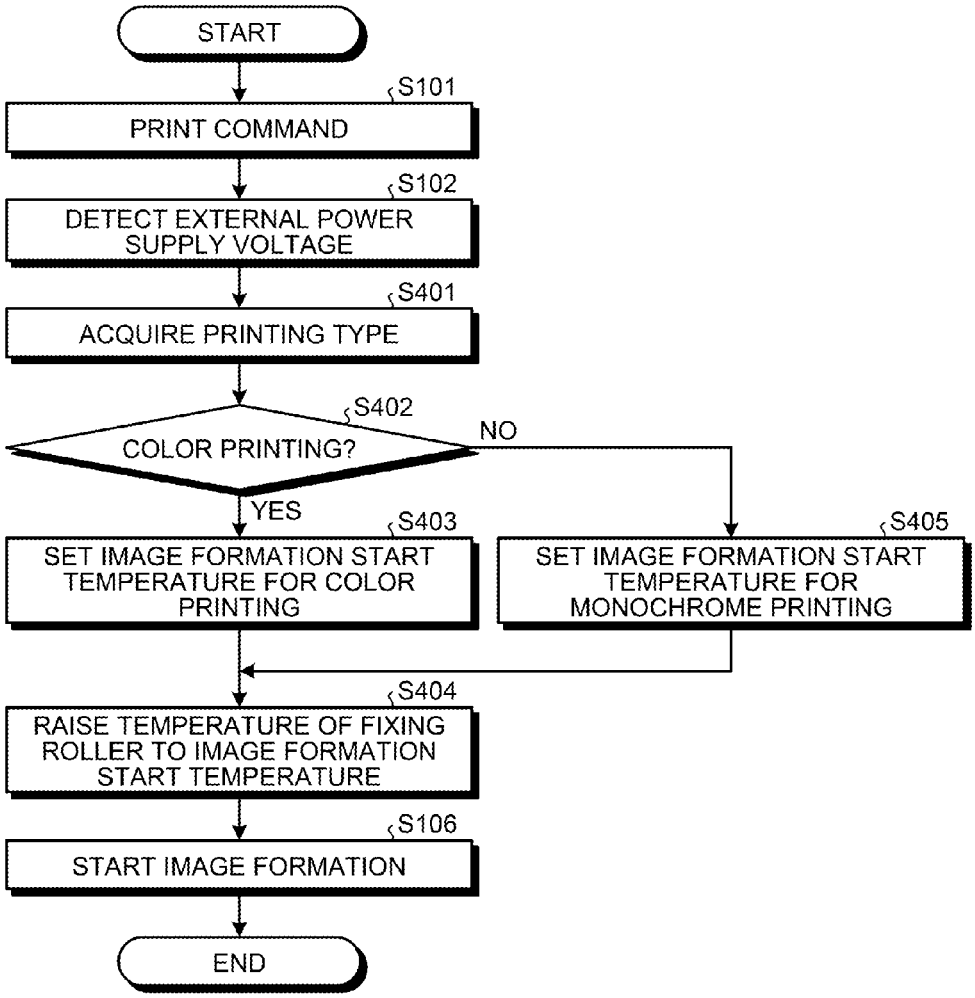
FIG. 10 is a flowchart illustrating a power saving control process in fixing based on whether image formation is in color or in monochrome.

Alternatively, the computation processing unit 71 may carry out the power saving control process in fixing taking whether the image formation is in color or in monochrome into account as illustrated in FIG. 10. In FIG. 10, the processing steps that are the same as those in FIG. 7 are designated by the same step numbers and the description thereof will be simplified.

In this case, as illustrated in FIG. 10, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 analyzes the print job to acquire whether the type (printing type) of image formation is color printing or monochrome printing (step S401) to check whether the image formation is color printing (step S402).

If the image formation is color printing in step S402 (YES in step S402), the computation processing unit 71 obtains and sets image formation start temperature for color printing (step S403). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S404). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

The computation processing unit 71 obtains the temperature reduction amount used for determining the image formation start temperature for color by an arithmetic expression similar to the expression (1) but using a coefficient set for color printing, for example. Alternatively, the computation processing unit 71 determines the temperature reduction amount for color by using a temperature reduction table stored in advance in the nonvolatile memory of the control unit 70 as a temperature reduction table that is a table similar to the temperature reduction table Tb in FIG. 3 but for color to obtain the image formation start temperature.

If the image formation is not color printing in step S402 (NO in step S402), that is, if the image formation is monochrome printing, the computation processing unit 71 obtains and sets image formation start temperature for monochrome printing (step S405). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S404). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

The computation processing unit 71 obtains the temperature reduction amount used for determining the image formation start temperature for monochrome by an arithmetic expression similar to the expression (1) but using a coefficient set for monochrome printing, for example. Alternatively, the computation processing unit 71 determines the temperature reduction amount for monochrome by using a temperature reduction table stored in advance in the nonvolatile memory of the control unit 70 as a temperature reduction table that is a table similar to the temperature reduction table Tb in FIG. 3 but for monochrome to obtain the image formation start temperature.

In this manner, image formation can be started with image formation start temperature set depending on whether image formation is in color or in monochrome, and it is possible to reduce power consumption in fixing while properly maintaining the image quality.

Figure 11:
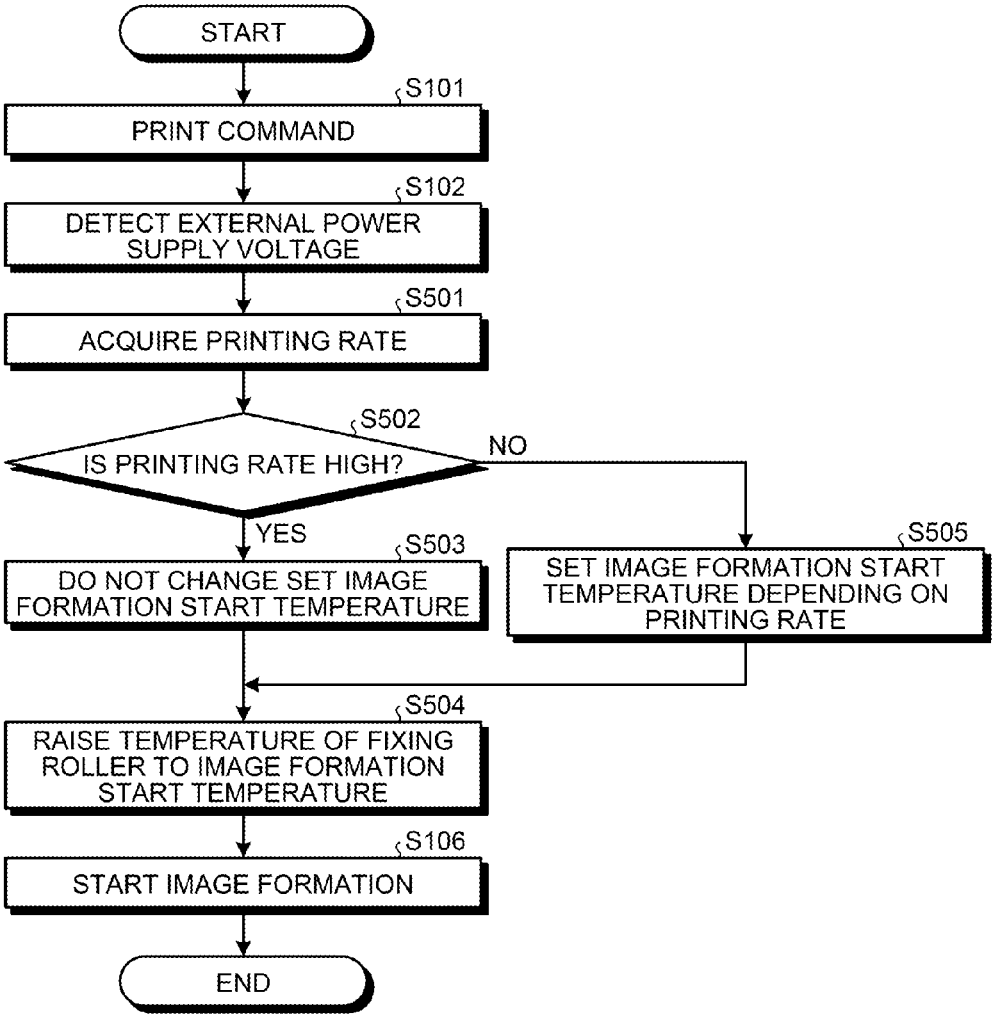
FIG. 11 is a flowchart illustrating a power saving control process in fixing based on a printing rate.

Still alternatively, the computation processing unit 71 may carry out the power saving control process in fixing on the basis of a printing rate (image ratio) that is a ratio of an image region to an image formation region as illustrated in FIG. 11. In FIG. 11, the processing steps that are the same as those in FIG. 7 are designated by the same step numbers and the description thereof will be simplified.

In this case, as illustrated in FIG. 11, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 analyzes the print job to acquire a printing rate (image ratio) in image data (step S501) to check whether the printing rate is higher than a threshold printing rate set in advance and stored in the nonvolatile memory (step S502).

If the printing rate is higher than the threshold printing rate in step S502 (YES in step S502), the computation processing unit 71 does not change the set image formation start temperature (step S503). After adopting the preset image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S504). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

If the printing rate is lower than the threshold in step S502 (NO in step S502), the computation processing unit 71 obtains and sets image formation start temperature depending on the acquired printing rate (step S505). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S504). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

The computation processing unit 71 obtains the temperature reduction amount for setting the image formation start temperature depending on the printing rate by an arithmetic expression similar to the expression (1) but using a coefficient set depending on a low printing rate, for example. Alternatively, the computation processing unit 71 obtains a temperature rising start time depending on the printing rate by using a temperature reduction table stored in advance in the nonvolatile memory of the control unit 70 as a temperature reduction table that is a table similar to the delay time table Tb in FIG. 3 but depending on the low printing rate.

In this manner, image formation can be started at an image formation start temperature lower than the preset image formation start temperature when the printing rate is low, and it is possible to reduce power consumption in fixing while properly maintaining the image quality.

Figure 12:
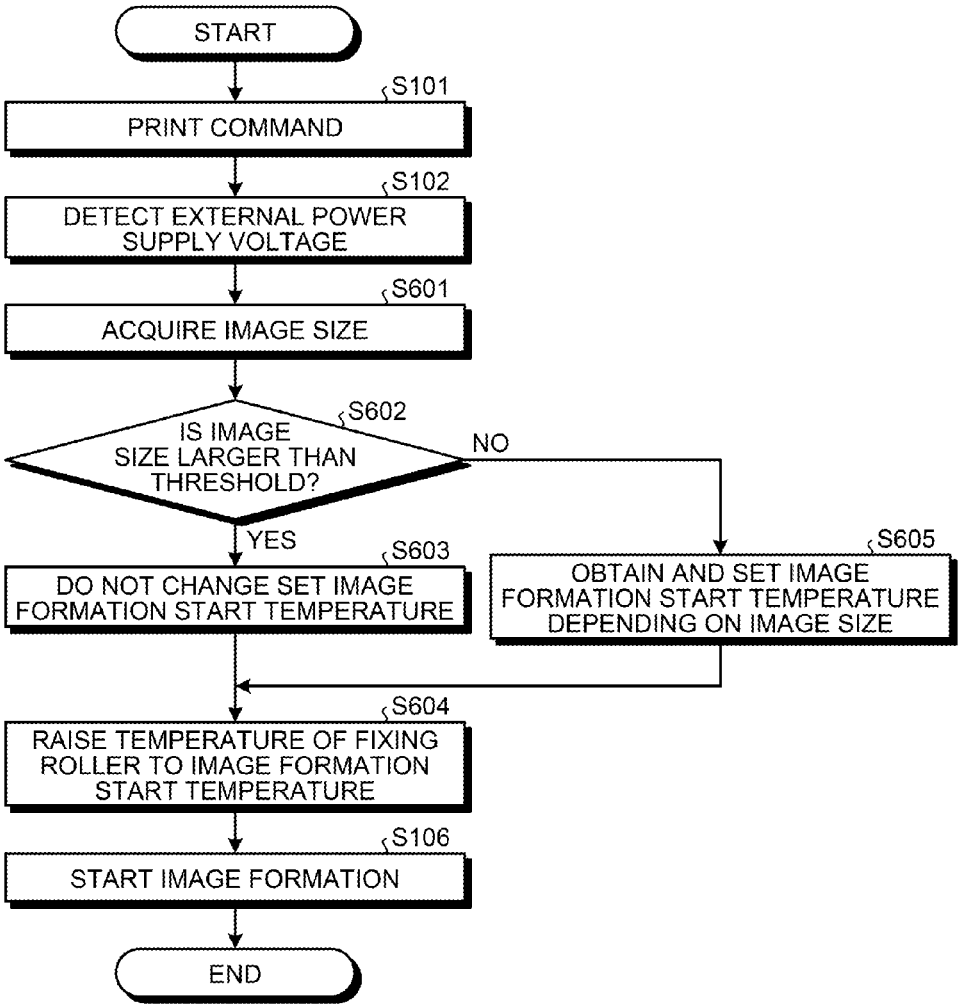
FIG. 12 is a flowchart illustrating a power saving control process in fixing based on an image size.

Alternatively, the computation processing unit 71 may carry out the power saving control process in fixing on the basis of the size of an image to be formed as illustrated in FIG. 12. In FIG. 12, the processing steps that are the same as those in FIG. 7 are designated by the same step numbers and the description thereof will be simplified.

In this case, as illustrated in FIG. 12, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 analyzes the print job to acquire the size (image size) of an image to be formed (step S601) to check whether the image size is larger than a threshold size set in advance and stored in the nonvolatile memory (step S602).

If the image size is larger than the threshold size in step S602 (YES in step S602), the computation processing unit 71 does not change the set image formation start temperature (step S603). After adopting the preset image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S604). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

If the image size is smaller than the threshold size in step S602 (NO in step S602), the computation processing unit 71 obtains and sets image formation start temperature depending on the acquired image size (step S605). After adopting the preset image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S604). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

The computation processing unit 71 obtains the temperature reduction amount for obtaining the image formation start temperature depending on the image size by an arithmetic expression similar to the expression (1) but using a coefficient set depending on a small image size, for example. Alternatively, the computation processing unit 71 obtains the temperature reduction amount based on the image size by using a temperature reduction table (image size associated temperature reduction table) stored in advance in the nonvolatile memory of the control unit 70 as a table of temperature reduction amounts that is a table similar to the temperature reduction table Tb in FIG. 3 but depending on the small image size.

In this manner, image formation can be started at an image formation start temperature lower than the preset image formation start temperature when the image size is small, and it is possible to reduce power consumption in fixing while properly maintaining the image quality.

Figure 13:
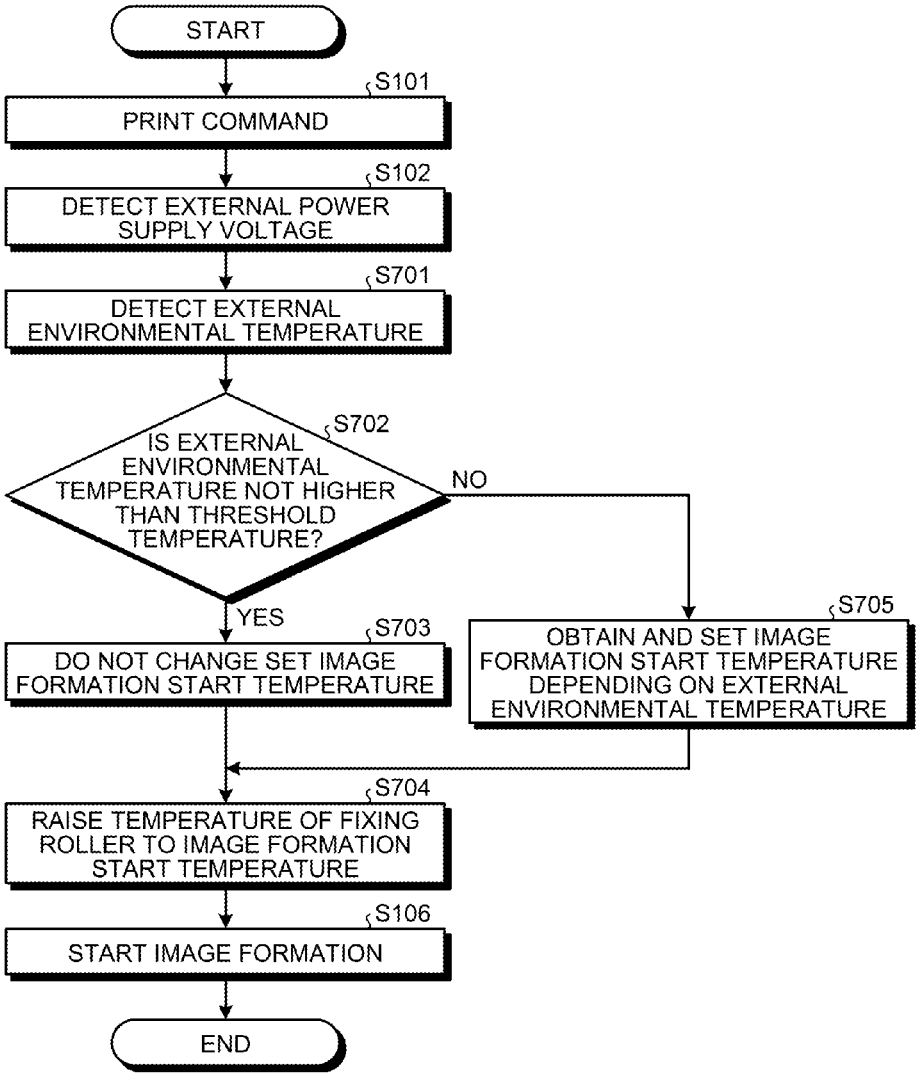
FIG. 13 is a flowchart illustrating a power saving control process in fixing based on external environmental temperature.

Still alternatively, the computation processing unit 71 may carry out the power saving control process in fixing on the basis of the external environmental temperature as illustrated in FIG. 13. In FIG. 13, the processing steps that are the same as those in FIG. 7 are designated by the same step numbers and the description thereof will be simplified. Specifically, the image forming apparatus 1 includes a temperature sensor, which is not illustrated, for detecting the external environmental temperature of the image forming apparatus 1, that is, at least the temperature outside of the fixing unit 30, and the temperature sensor outputs the detected external environmental temperature to the control unit 70.

In this case, as illustrated in FIG. 13, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 acquires the external environmental temperature from the temperature sensor (step S701), and checks whether the external environmental temperature is not higher than a threshold temperature set in advance and stored in the nonvolatile memory (step S702).

If the external environmental temperature is not higher than the threshold temperature in step S702 (YES in step S702), the computation processing unit 71 does not change the set image formation start temperature (step S703). After adopting the preset image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S704). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

If the external environmental temperature is higher than the threshold temperature in step S702 (NO in step S702), the computation processing unit 71 obtains and sets image formation start temperature depending on the acquired external environmental temperature (step S603). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S704). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process.

The computation processing unit 71 obtains the temperature reduction amount for setting the image formation start temperature depending on the external environmental temperature by an arithmetic expression similar to the expression (1) but using a coefficient set depending on a high external environmental temperature, for example. Alternatively, the computation processing unit 71 obtains the temperature reduction amount depending on the external environmental temperature by using an external environmental temperature associated temperature reduction table stored in advance in the nonvolatile memory of the control unit 70 as a table of temperature reduction amounts that is a table similar to the temperature reduction table Tb in FIG. 3 but depending on the high external environmental temperature.

In this manner, when the external environmental temperature is high, image formation can be started at an image formation start temperature lower than that when the external environmental temperature is low, and it is possible to reduce power consumption in fixing while properly maintaining the image quality.

Figure 14:
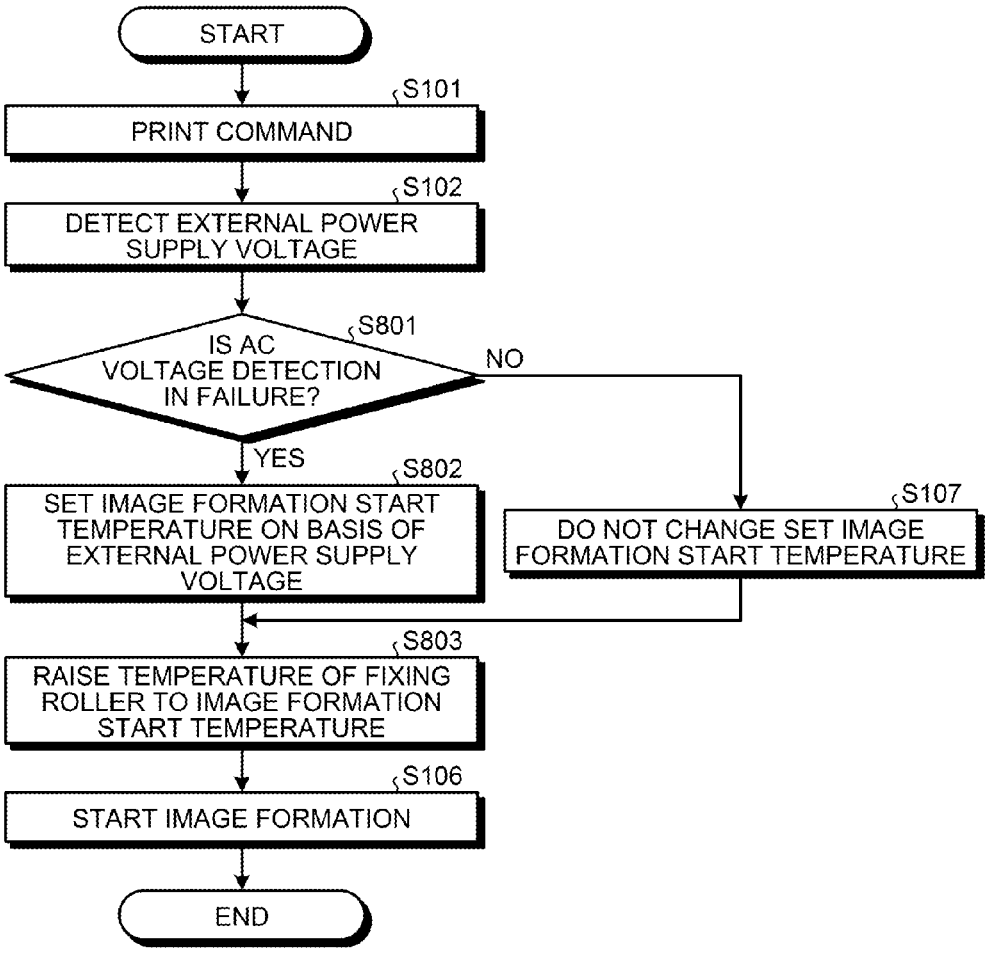
FIG. 14 is a flowchart illustrating a power saving control process in fixing based on presence/absence of failure in a voltage detection unit.

Alternatively, the computation processing unit 71 may carry out the power saving control process in fixing on the basis of the presence/absence of failure of the voltage detection unit as illustrated in FIG. 14. In FIG. 14, the processing steps that are the same as those in FIG. 7 are designated by the same step numbers and the description thereof will be simplified.

In this case, as illustrated in FIG. 14, when a print command is issued as a result of operation of the operation display unit, executing a print job received from a host device HS, which is not illustrated, or the like (step S101), the computation processing unit 71 acquires the external power supply voltage value from the voltage detection unit 85 (step S102).

The computation processing unit 71 determines whether or not the voltage detection unit 85 is in failure on the basis of the external power supply voltage value acquired from the voltage detection unit 85 (step S801). The computation processing unit 71 determines whether a failure is present or absent in the voltage detection unit 85 on the basis of whether the external power supply voltage value from the voltage detection unit 85 is a voltage within an abnormality determination threshold voltage range set in advance and stored in the nonvolatile memory of a voltage or out of the abnormality determination threshold voltage range, for example.

If the voltage detection unit 85 is not in failure in step S801 (NO in step S801), the computation processing unit 71 obtains and sets the image formation start temperature similarly to the case of FIG. 7 on the basis of the external power supply voltage value (step S802). After setting the image formation start temperature, the computation processing unit 71 outputs an output adjustment signal for starting supply of power for heating to the fixing heater 30*c*, to the output adjustment unit 84 of the power supply unit 80, and starts feeding the power to the fixing heater 30*c* to raise the temperature of the fixing roller 30*a* to the image formation start temperature (step S803). When the temperature of the fixing roller 30 detected by the thermistor 30*d* is raised to the image formation start temperature, the computation processing unit 71 makes the printing unit 4 start an image formation process (step S106). After the image formation and the fixing process are completed, the computation processing unit 71 terminates the image formation process. In this case, similarly to the case of FIG. 7, determination on whether or not the external power supply voltage value is near the lower voltage limit may be carried out, and the process may be controlled on the basis of the determination result.

If the voltage detection unit 85 is in failure in step S801 (YES in step S801), the computation processing unit 71 determines not to change the set image formation start temperature (step S107). The computation processing unit 71 outputs an output adjustment signal for starting supply of power for heating to the fixing heater 30*c* to the output adjustment unit 84 of the power supply unit 80, and starts feeding the power to the fixing heater 30*c* to raise the temperature of the fixing roller 30*a* to the preset image formation start temperature (step S803).

In this manner, when the voltage detection unit 85 is in failure, it is possible to prevent an abnormal temperature rise start time from being set on the basis of the external power supply voltage value detected by the voltage detection unit 85 in failure. As a result, it is possible to reduce power consumption in fixing while properly maintaining the image quality.

As described above, the image forming apparatus 1 according to the present embodiment includes a printing unit (image forming unit) 40 that forms a toner image (recording agent image) on a sheet (recording medium) P, a fixing unit (fixing unit) 30 that heats the sheet P on which the toner image is formed by the printing unit 40 and which is conveyed to the fixing unit 30, to fix the toner image onto the sheet P, a fixing heater (heating unit) 30*c* that heats a fixing roller 30*a* of the fixing unit 30 depending on the amount of fed power, a thermistor (temperature detection unit) 30*d* that detects the temperature of the fixing roller 30*a* of the fixing unit 30, a power supply unit (power supply generation unit) 80 that generates power for heating to be supplied to the fixing heater 30*c* from a power PS from external power supply, a voltage detection unit (voltage detection unit) 85 that detects a voltage value of the power PS from the external power supply, and a computation processing unit (control unit) 71 that determines, as the image formation start temperature, the temperature of the fixing roller 30*a* of the fixing unit 30 for making the image forming unit start image formation such that the timing at which the sheet P on which the toner image is formed reaches the fixing unit 30 is matched with the timing at which the temperature of the fixing unit is raised to the fixing temperature allowing fixing by the fixing unit as a result of starting feeding the power for heating to the fixing heater 30*c* on the basis of the voltage value of the power PS from the external power supply, and starts image formation by the printing unit 40 when the temperature of the fixing roller 30*a* of the fixing unit 30 reaches the image formation start temperature.

It is therefore possible to shorten the time until the start of image formation on the basis of the voltage value of the power PS from the external power supply and reduce power consumption during the time period. In addition, it is possible to heat the fixing roller 30*a* to the fixing temperature at a time point when the sheet P reaches the fixing roller 30*a* to reduce waste power consumption for raising the fixing roller 30*a* to the fixing temperature before the sheet P reaches the fixing roller 30*a* and maintaining the fixing temperature. As a result, it is possible to reduce power consumption in fixing.

Furthermore, the image forming apparatus 1 according to the present embodiment performs an image formation control method including an image formation processing step of forming a toner image (recording agent image) onto a sheet (recording medium) P, a fixing processing step of heating, by a fixing unit (fixing unit) 30, the sheet P on which the toner image is formed in the image formation processing step and which is conveyed, to fix the toner image onto the sheet P, a heating processing step of heating, by the fixing heater (heating unit) 30*c*, a fixing roller 30*a* of the fixing unit 30 depending on the amount of fed power, a temperature detection processing step of detecting the temperature of the fixing roller 30*a* of the fixing unit 30, a power supply generation processing step of generating power for heating to be supplied to the fixing heater 30*c* from power PS from external power supply, a voltage detection processing step of detecting a voltage value of the power PS from the external power supply, and a control processing step of determining, as an image formation start temperature, the temperature of the fixing roller 30*a* of the fixing unit 30 for causing image formation at the forming to be started such that the timing at which the sheet P on which the toner image is formed reaches the fixing unit 30 is matched with the timing at which the temperature is raised to the fixing temperature allowing fixing by the fixing unit 30 as a result of starting feeding the power for heating to the fixing heater 30*c* on the basis of the voltage value of the power PS from the external power supply, and causing image formation at the image formation processing step to be started when the temperature of the fixing roller 30*a* reaches the image formation start temperature.

It is therefore possible to shorten the time until the start of image formation on the basis of the voltage value of the power PS from the external power supply and reduce power consumption during the time period. In addition, it is possible to heat the fixing roller 30*a* to the fixing temperature at a time point when the sheet P reaches the fixing roller 30*a* to reduce waste power consumption for raising the fixing roller 30*a* to the fixing temperature before the sheet P reaches the fixing roller 30*a* and maintaining the fixing temperature. As a result, it is possible to reduce power consumption in fixing.

Furthermore, the image forming apparatus 1 according to the present embodiment has an image formation control program mounted thereon, the image formation control program causing a control processor such as the computation processing unit 71 to execute: an image formation process of forming a toner image (recording agent image) onto a sheet (recording medium) P, a fixing process of heating, by a fixing unit (fixing unit) 30, the sheet P on which the toner image is formed at the image formation process and which is conveyed, to fix the toner image onto the sheet P, a heating process of heating, by the fixing heater (heating unit) 30*c*, a fixing roller 30*a* of the fixing unit 30 depending on the amount of fed power, a temperature detection process of detecting the temperature of the fixing roller 30*a* of the fixing unit 30, a power supply generation process of generating power for heating to be supplied to the fixing heater 30*c* from the power PS from external power supply, a voltage detection process of detecting a voltage value of the power PS from the external power supply, and a control process of determining, as an image formation start temperature, the temperature of the fixing roller 30*a* of the fixing unit 30 for causing image formation at the forming to be started such that the timing at which the sheet P on which the toner image is formed reaches the fixing unit 30 is matched with the timing at which the temperature is raised to the fixing temperature allowing fixing by the fixing unit 30 as a result of starting feeding the power for heating to the fixing heater 30*c* on the basis of the voltage value of the power PS from the external power supply, and causing image formation at the image formation process to be started when the temperature of the fixing roller 30*a* reaches the image formation start temperature.

It is therefore possible to shorten the time until the start of image formation on the basis of the voltage value of the power PS from the external power supply and reduce power consumption during the time period. In addition, it is possible to heat the fixing roller 30*a* to the fixing temperature at a time point when the sheet P reaches the fixing roller 30*a* to reduce waste power consumption for raising the fixing roller 30*a* to the fixing temperature before the sheet P reaches the fixing roller 30*a* and maintaining the fixing temperature. As a result, it is possible to reduce power consumption in fixing.

Furthermore, the image forming apparatus 1 according to the present embodiment further includes an A/D converter (conversion unit) that converts an analog voltage value of the power PS from the external power supply detected by the voltage detection unit (voltage detection unit) 85 into a digital voltage value, and the computation processing unit (control unit) 71 uses the digital voltage value as the voltage value of the power PS from the external power supply to perform the image formation start control.

Thus, detection of the voltage value of the power PS from the external power supply can be performed with high accuracy with finer resolution of the A/D converter, and power consumption in fixing can be reduced with high accuracy.

Furthermore, the image forming apparatus 1 according to the present embodiment includes a nonvolatile memory (storage unit) that stores a temperature reduction table (image formation start temperature table) Tb in which a temperature difference of an image formation start temperature when the voltage value of the power from the external power supply is a first voltage value from a rated image formation start temperature that is an image formation start temperature when the voltage value of the power PS from the external power supply is a rated voltage value is registered in association with the first voltage value of the power PS from the external power supply, and the computation processing unit 71 controls the image formation start temperature by referring to the temperature reduction table TB on the basis of the voltage value of the power PS from the external power supply.

It is therefore possible to promptly and easily obtain the image formation start temperature by using the temperature reduction table Tb and carry out image formation start control. As a result, it is possible to reduce power consumption in fixing with high accuracy and at a high rate.

Furthermore, with the image forming apparatus 1 according to the present embodiment, when the voltage value of the power PS from the external power supply is higher than a threshold voltage value, the computation processing unit 71 makes the image formation start temperature lower than that when the voltage value is lower than the threshold voltage value.

Thus, as a result of lowering the image formation start temperature by the amount corresponding to the amount by which the time for raising the temperature of the fixing roller 30*a* to the fixing temperature is shortened by the power PS from the external power supply having a high voltage value, the time until the start of image formation can be shortened and the temperature of the fixing roller 30*a* can be accurately raised to the fixing temperature at the time point when the sheet P reaches the fixing roller 30*a*. As a result, it is possible to further properly reduce power consumption in fixing.

Furthermore, the image forming apparatus 1 according to the present embodiment further includes a computation processing unit (recording agent image type acquisition unit) 71 that acquires the type of a toner image to be formed indicating whether the toner image is either in monochrome or in color, and the computation processing unit 71 functioning as the control unit controls the image formation start temperature on the basis of the type of the toner image.

Thus, as a result of lowering the image formation start temperature by adjusting the image formation start temperature on the basis of the color image or the monochrome image, it is possible to shorten the time until the start of image formation and to raise the temperature of the fixing roller 30*a* to the fixing temperature suitable for the color image or the monochrome image at the time point when the sheet P reaches the fixing roller 30*a*. As a result, it is possible to further properly reduce power consumption in fixing while properly maintaining the image quality.

Furthermore, the image forming apparatus 1 according to the present embodiment further includes a computation processing unit (image ratio acquisition unit) 71 that acquires the ratio of the toner image to the sheet P, and the computation processing unit 71 functioning as the control unit controls the image formation start temperature on the basis of the image ratio.

Thus, as a result of adjusting the image formation start temperature on the basis of the image ratio (printing rate), it is possible to shorten the time until the start of image formation and to raise the temperature of the fixing roller 30*a* to the fixing temperature suitable for the printing rate at the time point when the sheet P reaches the fixing roller 30*a*. As a result, it is possible to further properly reduce power consumption in fixing while properly maintaining the image quality.

Furthermore, the image forming apparatus 1 according to the present embodiment further includes a computation processing unit (image size acquisition unit) 71 that acquires the image size of the toner image, and the computation processing unit 71 functioning as the control unit controls the image formation start temperature on the basis of the image size.

Thus, as a result of adjusting the image formation start temperature on the basis of the image size, it is possible to shorten the time until the start of image formation and to raise the temperature of the fixing roller 30*a* to the fixing temperature suitable for the image size at the time point when the sheet P reaches the fixing roller 30*a*. As a result, it is possible to further properly reduce power consumption in fixing while properly maintaining the image quality.

According to an embodiment, power used for fixing can be reduced.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit configured to form a recording agent image on a recording medium;

a fixing unit configured to, heat the recording medium on which the recording agent image is formed by the image forming unit, and fix the recording agent image onto the recording medium;

a heater configured to heat the fixing unit depending on an amount of generated power;

a temperature detector configured to detect a temperature of the fixing unit;

a power generator configured to generate the generated power based on an external power supply;

a voltage detector configured to detect a voltage value of the external power; and a controller configured to, determine, as an image formation start temperature, the temperature of the fixing unit for causing the image forming unit to start an image formation such that a timing at which the recording medium reaches the fixing unit is matched with a timing at which the temperature of the fixing unit is a fixing temperature, the fixing temperature allowing fixing of the recording agent image on the recording medium by the fixing unit, the image formation start temperature being a threshold standby temperature, adjust the image formation start temperature to a first temperature if the voltage value of the external power is equal to a threshold voltage value, the first temperature different from the threshold standby temperature, and make the image forming unit start the image formation when the temperature of the fixing unit reaches the image formation start temperature.

2. The image forming apparatus of claim 1, further comprising:

a converter configured to convert an analog voltage value of the external power into a digital voltage value, wherein the controller is configured to use the digital voltage value as the voltage value of the external power to perform an image formation start control.

3. The image forming apparatus of claim 1, further comprising:

a memory configured to, store an image formation start temperature table, the image formation start temperature table including at least one temperature reduction amount that corresponds to the external power, the at least one temperature reduction amount is subtracted from a preset image formation start temperature of the fixing roller to obtain the image formation start temperature of the fixing roller if the external power is different from a lower voltage value limit, wherein the controller is configured to control the image formation start temperature by referring to the image formation start temperature table based on the voltage value of the external power.

4. The image forming apparatus of claim 1, wherein when the voltage value of the external power is higher than a threshold voltage value, the controller is configured to make the image formation start temperature lower than the image formation start temperature when the voltage value of the external power is lower than the threshold voltage value.

5. The image forming apparatus of claim 1, wherein the controller is further configured to:

acquire whether the recording agent image to be formed on the recording medium is a type of either a monochrome type or of a color type, and control the image formation start temperature based on the type of the recording agent image.

6. The image forming apparatus of claim 1, wherein the controller is further configured to:

acquire an image ratio of the recording agent image to the recording medium, and control the image formation start temperature based on the image ratio.

7. The image forming apparatus of claim 1, wherein the controller is further configured to:

acquire an image size of the recording agent image, and control the image formation start temperature based on the image size.

8. An image formation control method comprising:

forming a recording agent image on a recording medium;

heating, by a fixing unit, the recording medium on which the recording agent image is formed;

fixing, by the fixing unit, the recording agent image onto the recording medium;

heating, by a heater, the fixing unit depending on an amount of generated power;

detecting a temperature of the fixing unit;

generating power for heating to be supplied to the heater from an external power;

detecting a voltage value of the external power supply;

determining, as an image formation start temperature, the temperature of the fixing unit for causing an image formation to be started such that a timing at which the recording medium reaches the fixing unit is matched with a timing at which the temperature of the fixing unit is a fixing temperature, the fixing temperature allowing fixing of the recording agent image on the recording medium by the fixing unit, the image formation start temperature being a threshold standby temperature;

adjusting the image formation start temperature to a first temperature if the voltage value of the external power is equal to a threshold voltage value, the first temperature different from the threshold standby temperature; and causing the image formation to be started when the temperature of the fixing unit reaches the image formation start temperature.

9. A non-transitory computer-readable medium storing computer readable instructions thereon, when executed by at least one processor, is configured to cause the at least one processor to execute:

forming a recording agent image on a recording medium;

heating, by a fixing unit, the recording medium on which the recording agent image is formed;

fixing, by the fixing unit, the recording agent image onto the recording medium;

heating, by a heater, the fixing unit depending on an amount of generated power;

detecting a temperature of the fixing unit;

generating power for heating to be supplied to the heater from an external power supply;

detecting a voltage value of the external power; and determining, as an image formation start temperature, the temperature of the fixing unit for causing an image formation to be started such that a timing at which the recording medium reaches the fixing unit is matched with a timing at which the temperature of the fixing unit is a fixing temperature, the fixing temperature allowing fixing of the recording agent image on the recording medium by the fixing unit, the image formation start temperature being a threshold standby temperature;

adjusting the image formation start temperature to a first temperature if the voltage value of the external power is equal to a threshold voltage value, the first temperature different from the threshold standby temperature; and causing the image formation to be started when the temperature of the fixing unit reaches the image formation start temperature.

10. The method of claim 8, further comprising:

storing an image formation start temperature table, the image formation start temperature table including at least one temperature reduction amount that corresponds to the external power, the at least one temperature reduction amount is subtracted from a preset image formation start temperature of the fixing roller to obtain the image formation start temperature of the fixing roller if the external power is different from a lower voltage value limit.

11. The method of claim 8, further comprising:

setting the image formation start temperature lower when the voltage value of the external power is higher than a threshold voltage value; and setting the image formation start temperature higher when the voltage value of the external power is lower than the threshold voltage value.

12. The method of claim 8, further comprising:

converting an analog voltage value of the external power into a digital voltage value; and using the digital voltage value as the voltage value of the external power to perform an image formation start control.

13. The non-transitory computer-readable medium of claim 9, wherein the at least one processor is further configured to, store an image formation start temperature table, the image formation start temperature table including at least one temperature reduction amount that corresponds to the external power, the at least one temperature reduction amount is subtracted from a preset image formation start temperature of the fixing roller to obtain the image formation start temperature of the fixing roller if the external power is different from a lower voltage value limit.

14. The non-transitory computer-readable medium of claim 9, wherein the at least one processor is further configured to, set the image formation start temperature lower when the voltage value of the external power is higher than a threshold voltage value; and set the image formation start temperature higher when the voltage value of the external power is lower than the threshold voltage value.

15. The non-transitory computer-readable medium of claim 9, wherein the at least one processor is further configured to, convert an analog voltage value of the external power into a digital voltage value; and use the digital voltage value as the voltage value of the external power to perform an image formation start control.

* * * * *